US008529738B2

(12) United States Patent
Von Gutfeld et al.

(10) Patent No.: US 8,529,738 B2
(45) Date of Patent: Sep. 10, 2013

(54) IN SITU PLATING AND ETCHING OF MATERIALS COVERED WITH A SURFACE FILM

(75) Inventors: Robert J. Von Gutfeld, New York, NY (US); Alan C. West, Tenafly, NJ (US)

(73) Assignee: The Trustees of Columbia University in the City of New York, New York, NY (US)

( * ) Notice: Subject to any disclaimer, the term of this patent is extended or adjusted under 35 U.S.C. 154(b) by 1039 days.

(21) Appl. No.: 11/767,461

(22) Filed: Jun. 22, 2007

(65) Prior Publication Data

US 2008/0142367 A1 Jun. 19, 2008

Related U.S. Application Data

(63) Continuation-in-part of application No. PCT/US2006/004329, filed on Feb. 8, 2006.

(60) Provisional application No. 60/650,870, filed on Feb. 8, 2005, provisional application No. 60/675,114, filed on Apr. 25, 2005, provisional application No. 60/700,877, filed on Jul. 20, 2005, provisional application No. 60/815,790, filed on Jun. 22, 2006, provisional application No. 60/845,586, filed on Sep. 19, 2006.

(51) Int. Cl.
*C25D 5/34* (2006.01)

(52) U.S. Cl.
USPC ..... 204/275.1; 204/242; 205/205; 205/660

(58) Field of Classification Search
USPC ..... 204/242, 275.1; 205/205, 660
See application file for complete search history.

(56) References Cited

U.S. PATENT DOCUMENTS 2,964,453 A 12/1960 Garn et al.
3,582,478 A 6/1971 Kelly et al.

(Continued)

FOREIGN PATENT DOCUMENTS

CN 1793434 6/2006
JP 60-204899 A 10/1985

(Continued)

OTHER PUBLICATIONS

Lowenheim, F., Ed. John Wiley & Sons Inc.; Modern Electroplating; (3rd edition); 1974; pp. 591-625.

(Continued)

*Primary Examiner* — Nicholas A Smith
(74) *Attorney, Agent, or Firm* — Baker Botts LLP

(57) ABSTRACT

Systems and methods for plating and/or etching of hard-to-plate metals are provided. The systems and methods are designed to overcome the deleterious effect of superficial coating or oxide layers that interfere with the plating or etching of certain metal substrates. The systems and methods involve in situ removal of coating materials from the surfaces of the metal substrates while the substrates are either submerged in plating or etching solutions, or are positioned in a proximate enclosure just prior to submersion in the plating or etching solutions. Further, the substrates can be in contact with a suitable patterning mask to obtain patterned oxide-free regions for plating or etching. This in situ removal of coating layers may be achieved by pulse heating or photoablation of the substrate and the inhibiting coating layers. Electrical energy or laser light energy may be used for this purpose. Additionally or alternatively, the coating materials may be removed by mechanical means.

2 Claims, 29 Drawing Sheets

(56) References Cited

U.S. PATENT DOCUMENTS

| | | | | |
|---|---|---|---|---|
| 3,790,738 | A | 2/1974 | Laub et al. | |
| 4,169,770 | A | 10/1979 | Cooke et al. | |
| 4,217,183 | A | 8/1980 | Melcher et al. | |
| 4,229,264 | A | 10/1980 | Graunke | |
| 4,283,259 | A | 8/1981 | Melcher et al. | |
| 4,348,263 | A | 9/1982 | Draper et al. | |
| 4,395,320 | A | 7/1983 | Kasashima et al. | |
| 4,432,855 | A | 2/1984 | Romankiw et al. | |
| 4,497,692 | A | 2/1985 | Gelchinski et al. | |
| 4,629,539 | A | 12/1986 | Imai | |
| 4,895,633 | A | 1/1990 | Seto et al. | |
| 4,904,340 | A * | 2/1990 | Miracky et al. | 216/87 |
| 4,917,774 | A | 4/1990 | Fisher | |
| 4,919,769 | A | 4/1990 | Lin | |
| 5,057,184 | A * | 10/1991 | Gupta et al. | 216/65 |
| 5,202,291 | A | 4/1993 | Charvat et al. | |
| 5,245,847 | A | 9/1993 | Bando et al. | |
| 5,279,702 | A | 1/1994 | Douglas | |
| 5,292,418 | A | 3/1994 | Morita et al. | |
| 5,296,375 | A | 3/1994 | Kricka et al. | |
| 5,338,416 | A | 8/1994 | Mlcak et al. | |
| 5,364,510 | A | 11/1994 | Carpio | |
| 5,378,343 | A | 1/1995 | Kounaves et al. | |
| 5,704,493 | A | 1/1998 | Fujikawa et al. | |
| 5,906,723 | A | 5/1999 | Mathies et al. | |
| 5,928,880 | A | 7/1999 | Wilding et al. | |
| 5,932,799 | A | 8/1999 | Moles | |
| 6,042,712 | A | 3/2000 | Mathieu | |
| 6,110,354 | A | 8/2000 | Saban et al. | |
| 6,159,353 | A | 12/2000 | West et al. | |
| 6,165,630 | A | 12/2000 | Gehlhaar et al. | |
| 6,280,602 | B1 | 8/2001 | Robertson | |
| 6,334,980 | B1 | 1/2002 | Hayes et al. | |
| 6,391,559 | B1 | 5/2002 | Brown et al. | |
| 6,423,207 | B1 | 7/2002 | Heidari et al. | |
| 6,509,085 | B1 | 1/2003 | Kennedy | |
| 6,521,118 | B1 | 2/2003 | Starosvetsky et al. | |
| 6,532,642 | B1 | 3/2003 | Wingo | |
| 6,787,012 | B2 | 9/2004 | Stanbery | |
| 6,936,167 | B2 | 8/2005 | Hobbs et al. | |
| 7,079,760 | B2 | 7/2006 | Hamelin et al. | |
| 7,192,559 | B2 | 3/2007 | Chow et al. | |
| 2002/0046949 | A1 | 4/2002 | Nakamura et al. | |
| 2002/0125142 | A1 | 9/2002 | Sun et al. | |
| 2002/0195345 | A1 | 12/2002 | Bentsten et al. | |
| 2003/0008473 | A1 * | 1/2003 | Sakaguchi et al. | 438/409 |
| 2003/0029722 | A1 | 2/2003 | Erdosy et al. | |
| 2004/0166504 | A1 | 8/2004 | Rossier et al. | |
| 2005/0173253 | A1 | 8/2005 | Huang | |
| 2005/0224359 | A1 | 10/2005 | Su et al. | |
| 2005/0241948 | A1 | 11/2005 | Han et al. | |
| 2006/0003579 | A1 | 1/2006 | Sir | |
| 2008/0245674 | A1 | 10/2008 | Von Gutfeld et al. | |
| 2008/0264801 | A1 | 10/2008 | West et al. | |
| 2008/0299780 | A1 | 12/2008 | Elliott et al. | |
| 2009/0081386 | A1 | 3/2009 | Von Gutfeld et al. | |
| 2010/0084286 | A1 | 4/2010 | West | |
| 2011/0104396 | A1 | 5/2011 | Von Gutfeld et al. | |

FOREIGN PATENT DOCUMENTS

| | | |
|---|---|---|
| JP | 04-066679 A | 3/1992 |
| JP | 2011071700 | 4/2011 |
| WO | WO9510040 | 4/1995 |
| WO | WO2006086407 | 8/2006 |
| WO | WO2006110437 | 10/2006 |

OTHER PUBLICATIONS

O.Mallory, Glenn; Hajdu, Juan B.; Fundamentals and Applications; American Electroplaters and Surface Finishers Society; 1990; pp. 193-204.

T. Kikuchi et al.; Local surface modification of aluminum by laser irradiation; Electrochimica Acta 47; 2001; pp. 225-234.

U.S. Appl. No. 11/867,399, Oct. 19, 2011 Final Office Action.

U.S. Appl. No. 11/867,399, Aug. 24, 2011 Response to Non-Final Office Action.

U.S. Appl. No. 11/867,399, Mar. 24, 2011 Non-Final Office Action.

U.S. Appl. No. 12/040,378, Oct. 10, 2011 Amendment and Request for Continued Examination (RCE).

U.S. Appl. No. 12/040,378, Oct. 4, 2011 Advisory Action.

U.S. Appl. No. 12/040,378, Sep. 20, 2011 Response to Final Office Action.

U.S. Appl. No. 12/040,378, Jun. 9, 2011 Final Office Action.

U.S. Appl. No. 12/040,378, Mar. 28, 2011 Response to Non-Final Office Action.

U.S. Appl. No. 12/040,378, Oct. 28, 2010 Non-Final Office Action.

U.S. Appl. No. 12/478,591, Aug. 10, 2011 Non-Final Office Action.

Ogden et al., "Cylic Voltaammetric Stripping Analysis of Copper Plating Baths", *Applications of Polarization Measurements in the Control of Metal Deposition*, 1984: 229-240.

Wills et al., "Laser micromachining of indium tin oxide films on polymer substrates by laser-induced delamination", *J. Phys. D: Appl. Phys.*, 42 (2009) 045306 (8pp).

U.S. Appl. No. 12/478,591, Nov. 23, 2011 Final Office Action.

U.S. Appl. No. 12/478,591, Nov. 10, 2011 Response to Non-Final Office Action.

U.S. Appl. No. 12/040,378, Dec. 22, 2011 Non-Final Office Action.

U.S. Appl. No. 12/040,378, Apr. 27, 2012 Response to Non-Compliant.

U.S. Appl. No. 12/040,378, Apr. 10, 2012 Notice of Non-Compliant.

U.S. Appl. No. 12/478,591, Apr. 23, 2012 Amendment and Request for Continued Examination (RCE).

U.S. Appl. No. 11/867,399, Feb. 21, 2012 Amendment and Request for Continued Examination (RCE).

U.S. Appl. No. 12/208,287, Jun. 29, 2012 Non-Final Office Action.

U.S. Appl. No. 12/040,378, Jun. 28, 2012 Final Office Action.

U.S. Appl. No. 12/478,591, Jul. 9, 2012 Notice of Allowance.

U.S. Appl. No. 11/867,399, Jan. 28, 2013 Response to Non-Final Office Action.

U.S. Appl. No. 12/040,378, Dec. 11, 2012 Non-Final Office Action.

U.S. Appl. No. 12/040,378, Nov. 27, 2012 Amendment and Request for Continued Examination (RCE).

U.S. Appl. No. 12/208,287, Dec. 28, 2012 Response to Non-Final Office Action.

U.S. Appl. No. 11/867,399, Aug. 21, 2012 Non-Final Office Action.

Darling, et al., "Integration of microelectrodes with etched microchannles for in-stream electrochemical analysis", *Micro Total Analysis Systems*, pp. 105-108 (1998).

* cited by examiner

Ex-situ substrate preparation-single elements

2000

A

Front face of patterned sample prior to immersion

IN SITU PLATING AND ETCHING OF MATERIALS COVERED WITH A SURFACE FILM

CROSS REFERENCE TO RELATED APPLICATIONS

This application is a continuation-in-part of International Application No. PCT/US06/04329, filed Feb. 8, 2006, which claims priority to U.S. provisional patent application Nos. 60/650,870, filed Feb. 8, 2005; 60/675,114, filed Apr. 25, 2005; and 60/700,877, filed Aug. 3, 2005, all of which are incorporated by reference in their entireties herein. Further, this application claims the benefit of U.S. provisional patent application Nos. 60/815,790, filed Jun. 22, 2006 and 60/845,586, filed Sep. 19, 2006, both of which are also incorporated by reference in their entireties herein.

BACKGROUND OF THE INVENTION

The present invention relates to systems and methods for metal plating and etching of substrates. More particularly, the invention relates to metal plating and etching of readily oxidizable substrates or other substrates with thin layers that inhibit plating and etching.

Metal plating of articles or base substrates is a common industrial practice. A metal layer may be coated or plated on the surface of an article, for example, for decoration, reflection of light, protection against corrosion, or increased wearing quality. Articles or base substrates, which are made of metal or non-metallic material, may be plated with suitable coating metals using techniques such as electroplating, electroless plating, metal spraying, hot dip galvanizing, vacuum metallization or other available processes. Plating by electrolysis, or electroplating, is a commonly used technique for metal plating because it permits the control of the thickness of the plating. Cadmium, zinc, silver, gold, tin, copper, nickel, and chromium are commonly used plating/coating metals. In immersion or electroless plating, some metals are directly precipitated, without electricity, from chemical solutions onto the surface of the substrates. The silvering of mirrors is a type of plating in which silver is precipitated chemically on glass. Any of the common metals and some nonmetals, e.g., plastics, with suitably prepared (e.g., etched) surfaces can be used as the article or base substrate material.

However, some metals (e.g., aluminum and refractory metals like tungsten, tantalum and molybdenum), which have desirable physical or structural properties for use as base substrate material, are extremely difficult to plate by simple immersion plating or electroplating techniques. The difficulty in plating these metals may, for example, be related to the propensity of these metals to oxidize in air, as a result of which an interfering metal-oxide or insulating layer forms on any exposed or etched surface of these metals. The interfering metal-oxide or insulating layer hinders reduction of metal ions, which is required to cause metal plating. Therefore, techniques for metal plating readily-oxidizable materials (such as tungsten, tantalum and aluminum) commonly involve a number of expensive and tedious substrate preparation steps, which are designed to avoid or prevent the formation of surface layers which can interfere with the plating processes. For example, a common technique for metal plating onto an aluminum substrate involves first zincating and then gold plating the aluminum substrate prior to plating the aluminum substrate with a metal of choice. For substrates or articles made from refractory metals such as tantalum and tungsten, the substrate preparation steps prior to metal plating often involve cumbersome high temperature processing steps.

The interfering surface oxide layers formed on these readily-oxidizable metals also hinders etching of the surface of these metals, which may be necessary prior to any substrate preparation steps themselves. The surface oxide layer coating prevents the dissolution of the metal under conventional etching conditions. Again, a number of fairly harsh steps are required to prepare the substrate surfaces for etching. See e.g., Modern Electroplating (3rd edition), F. Lowenheim, Ed. John Wiley & Sons Inc. (1974), pp. 591-625. Further discussion of electroless plating of common materials that require multi-step processing to achieve metal plating due to presence of interfering surface films may, for example, be found, in Electroless Plating: Fundamentals and Applications, Glenn O. Mallory and Juan B. Hajdu, Eds. American Electroplaters and Surface Finishers Society (1990), pp. 193-204.

Consideration is now being given to improving metal plating systems and methods. Attention is particularly directed to simplifying techniques for metal plating of substrates on which interfering surface films form, for example, during conventional metal plating processes or steps. Further, attention is directed to substrate preparation techniques (i.e., removal of native or preformed surface oxide layers) prior to plating or etching action.

SUMMARY OF THE INVENTION

The present invention provides systems and methods for etching and/or metal plating of substrate materials, which are usually coated with thin surface films (e.g., a native oxide film). The systems and methods may employ several in situ techniques for removing the thin surface film, including direct heating and mechanical removal. The systems and methods may alternatively exploit optical energy absorption to remove or inhibit the thin surface films before etching and/or metal plating of substrate materials. An energy beam (e.g., a laser beam), which is generated by a suitable optical source (e.g., a laser), is directed onto the surface of a substrate. Optical absorption of the directed energy beam can lead to localized heating and/or photodecomposition (also known as ablative photodecomposition) of the thin surface film.

The removal of the thin surface film material is, in one preferred embodiment, performed "in situ" while the substrate is immersed in plating or etching solution. After the thin surface film material is removed, the plating or etching solution can act on the exposed substrate surfaces before a thin surface film can re-form or reappear. This in situ technique advantageously avoids exposure of clean substrate surfaces to air, preventing surface oxidation.

In a variation of the in situ removal technique, the removal of the thin surface film material from the substrate surface is performed prior to immersion of the substrate in the plating/etching bath. The removal of the thin surface film material may be carried out in normal ambient or in a coating-removal enclosure having a specific inert or reducing atmosphere. The enclosure may be in close proximity or attached to the tank, which holds the bath in which the substrate is subsequently immersed for plating or etching. After removal of the thin surface film or coating, the substrate is transferred, for example, from the enclosure into the plating/etching bath, in a short time before any oxide film can reappear or regrow on the substrate surface. This variation of the removal technique advantageously avoids any significant exposure of clean substrate surfaces to air prior to plating or etching action. The transfer also may be carried out in a reducing or inert atmosphere, for example, when the enclosure is attached to the tank, to avoid all exposure to air prior to plating or etching action.

In a further variation of the in-situ removal technique, the oxide-coated substrate is placed in contact with a suitable patterning mask. Surface oxide removal is performed through openings in the contact patterning mask to prepare designated surface pattern regions for plating or etching. A suitable patterning mask may be a photoresist pattern layer, which is applied using conventional photolithoprahic techniques (e.g., using contact or non contact photomasks). For some applications that do not require very precise feature definitions, a suitable patterning mask may, for example, be fabricated by applying masking tape (or any other non-conducting material) directly to the substrate surface to cover or mask surface regions that are not to be plated or etched.

BRIEF DESCRIPTION OF THE DRAWINGS

Further features of the invention, its nature, and various advantages will be more apparent from the following detailed description of the preferred embodiments and the accompanying drawings, wherein like reference characters represent like elements throughout, and in which.

DETAILED DESCRIPTION OF THE INVENTION

Figure 1A:
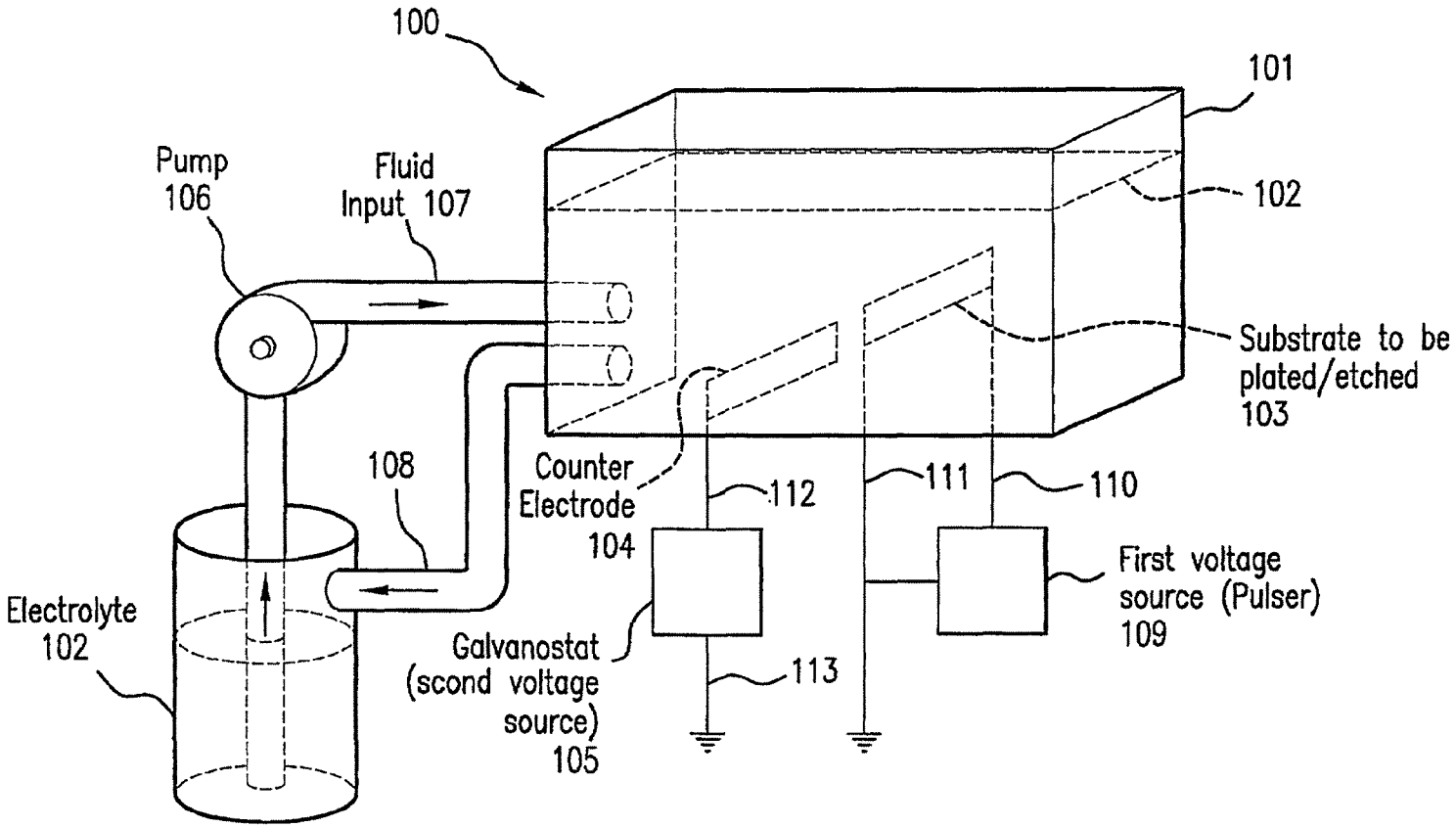
FIG. 1*a* is a schematic illustration of an exemplary plating/etching cell arrangement, which is configured for removing an interfering insulating surface film by in situ resistive heat treatment just prior to or during the metal plating or etching of a subject substrate, in accordance with the principles of the present invention. The cell is provided with a counter electrode and pump for circulating an electrolyte or etchant.

The present invention provides systems and methods for metal plating and etching of substrates that are covered by interfering surface films. The plating and etching methods involve in situ removal of the interfering surface films or surface preparation in such a way that plating/etching becomes possible. The in situ removal of the interfering surface films may be obtained by in situ application of heat, laser light, or mechanical abrasion, or by similar ex situ methods including, for example, placing the substrate in a reducing gas atmosphere. Accordingly, various plating/etching cell arrangements are provided for in situ application of resistive heating, laser light, mechanical abrasion, or reducing gas to the subject substrate just prior to or even as the subject substrate is undergoing etching or plating processes.

The invention enables convenient manufacture of metal-plated articles that are made from structurally desirable substrate materials, which are readily oxidizable (e.g., aluminum, and refractory metals). For these metal-plated articles, the metal plating is deposited on or bonded directly to the underlying substrate material dispensing with the need for intermediate substrate modification or seed layers. The invention, for example, enables manufacture of metal-plated aluminum articles in which the metal coating (e.g., nickel) is deposited directly on the aluminum substrate without any intervening zinc or gold seed layers.

It is well known that many materials, particularly metals develop an oxide coating or may have some other form of a thin surface layer, which may act as a protective coating. For those cases, it is necessary to remove the oxide or coating in some manner prior to subjecting the material to plating or etching. The removal of such surface layers is necessary for electroplating, electroless plating, immersion plating, electro etching and chemical etching of the material. The various plating/etching systems or arrangements described herein are designed to remove the protective coatings either while or just before the materials are submerged in the electrolyte, which is used for carrying out the desired plating/etching processes. These plating/etching systems or arrangements allow removal of interfering coatings or surface films on a substrate (e.g., where the coating or surface film is a naturally grown oxide) without requiring any subsequent exposure, or at least any significant subsequent exposure, of the substrate to air prior to placing it in a plating/etching cell. Some of the plating/etching systems are designed so that suitable preprocessing or coating removal steps are carried out in close proximity to the plating/etching bath, either in air or in a controlled atmosphere enclosure. Further, the plating/cell systems are designed to reduce and simplify the number of processing steps common in conventional metal plating/etching processes that are performed in separate baths, tanks or ovens, and in particular to avoid the cumbersome high temperature processing steps.

All metallization/etching process steps can take place in situ or immediately after oxide removal so that there is no significant exposure of the substrate to air between the oxide removal and the plating/etching process steps. The inventive processes avoid conventional expensive and somewhat cumbersome coating removal steps such as are presently required in plating onto, for example, an aluminum substrate.

Conventional procedures for metal plating aluminum substrates involve a number of steps to overcome the deleterious effects of aluminum oxide coatings that form on exposed aluminum surfaces. These steps may include zincating followed by gold plating before the metal of choice can be plated onto the aluminum substrate. By application of the present invention, interfering aluminum oxide materials can be readily removed in situ by any of the several techniques described herein, which avoid exposing the substrate material to air (or oxygen) or limit such exposure to less than a few seconds. Short exposures to air of about 1 to 10 seconds have been shown to be benign with respect to plating and etching quality. Thus, plating and etching steps may be initiated immediately or within 1-10 seconds after the interfering coating materials on the aluminum substrate are removed. This in situ processing also may be similarly advantageous for metal plating or etching of refractory metal substrates such as tungsten, tantalum, titanium, molybdenum and rhenium.

An exemplary plating/cell arrangement or system, which is designed for in situ processing of difficult substrates (i.e., substrates whose outer surfaces are coated by an interfering film that makes direct plating or etching difficult or impossible), may include a fluid-holding tank which can hold a fluid electrolyte (e.g., copper sulfate, nickel sulfate or other chemical solutions), an electroless plating solution (e.g., electroless gold) or a chemical etchant (e.g., hydrogen fluoride, sodium hydroxide or the like). The tank may be suitably sized so that the subject substrate (which is preferably electrically conductive) can be fully submerged or partially submerged in the fluid. This exemplary plating/cell arrangement or system may be modified to include an enclosure in close proximity or attached to the fluid-holding tank. This enclosure may be used for substrate preprocessing steps including coating removal steps prior to submerging the substrate in the fluid tank.

In one version of plating/etching cell arrangement, heat is applied to the substrate while submerged in the plating/etching solution to remove the offending film or coating from the surfaces of the substrate. The heat may be applied as resistive heat, which is locally generated by passing a high current through the substrate. The high current flow may be intermittent. A first voltage/current source, whose leads are connected to opposite ends of the substrate, is provided for this purpose. The voltage/current source may be any suitable pulser or pulsed voltage source that can produce a high current. Suitable pulsers produce pulses that are that are greater than 100 ps wide. The resistive or Joule heating due to the passage of current within the substrate serve to heat the substrate, whereby this heat can lead to dissolution or disintegration of the offending coating. The offending coating may be removed possibly by ablation, melting, or cracking due to differential thermal expansion. Once the coating has been removed and the pulser is no longer operating, the substrate may remain free of coating in the plating or etching fluid free of coating for at least about 0.1 second, but often for a much longer time on the order of minutes.

In a variation of the inventive processes, coating removal steps, which may be similar to the heat, mechanical or other coating removal steps described above, may be performed before submerging the substrate in the fluid tank. For such processes, the plating/etching cell system or arrangement may be provided with a separate enclosure in close proximity or attached to the fluid tank. The separate enclosure may have a controlled atmosphere, which can be beneficial to the coating removal process. For example, a reducing gas (e.g., HF gas) atmosphere may be used to remove an offending substrate coating (e.g., an oxide coating) by chemical reduction of the coating. Further, for example, an inert gas atmosphere may be used to hinder oxide regrowth during heat or mechanical coating removal steps. In some instances when mechanical removal of the coating can be successfully achieved in an air ambient, the provision of a separate coating removal enclosure in the plating/etching cell arrangement may be unnecessary.

In any of the plating/etching cell systems or arrangements including arrangements in which resistive Joule heating is utilized for removing a coating while the substrate is submerged in the fluid tank, a coating-free substrate can act as a working electrode while submerged in the fluid. A suitably positioned counter electrode may be submerged in the tank fluid for conducting electrolytic metal plating or etching. A second voltage/current source may be connected between the counter electrode and the substrate to provide current for electrolytic action. In the case where the fluid is an electrolyte, the second voltage/current source may be activated at suitable times to cause electrolytic plating or etching of the substrate when the substrate surface is free of the offending coating. Thus steady (continuous wave) or pulse plating and etching can be accomplished.

In a typical electroplating/electroetching process using the present invention in which both the coating removal process and the plating/etching process occur within the plating bath, the second source of voltage may be applied immediately after the current pulse applied by the first voltage source (used for resistive Joule heating) is terminated. Alternatively, the second voltage/current source may be activated even before or during the application of the current pulse to remove the substrate coating. In instances where the fluid in the tank is an electrolyte, it also may be possible to obtain exchange plating (e.g., immersion plating) without the use of the second voltage source for certain electrolyte and substrate combinations. If the electrolyte fluid contains a more noble metal than the substrate material then, once the offending coating is removed from the substrate surface, the more noble metal atom will plate or deposit on the surface by replacing an exposed substrate surface atom.

The plating/etching cell arrangement also may be used for an electroless plating (using a fluid which is an electroless plating solution). In such application, a catalyst in the electroless solution leads to plating without any applied voltage to the substrate electrode. Accordingly, it is not necessary to use the counter electrode and second voltage source to produce plating. Similarly, when a chemical etchant is used as the tank fluid, etching of the substrate may readily occur without the use of the counter electrode or second voltage source once the surface coating is removed by heat or mechanical treatment.

In yet another version of the in situ plating/etching cell arrangement, the first voltage/current source, which is used to heat the substrate for in situ removal of the offending coating layers, may be replaced as a heat energy source by any suitable energy beam that can penetrate the fluid or the gas in the enclosure of the alternate embodiment to reach the substrate surface. The energy beam (e.g., a laser beam) may be generated by a laser. The laser beam may be directed onto the substrate surface through an optical fiber or an optical waveguide (e.g., a light pipe). Alternatively, the laser beam may, in certain instances, be directed onto the substrate through the electrolyte without the use of a light pipe or optical fiber.

Similar localized surface heating may occur with the use of either the voltage source or the laser beam as the heat or photoablative energy source for removing the substrate coating while the substrate is submerged or is in the preprocessing enclosure. The plating/etching cell arrangement may be configured with a suitable fluid stirring mechanism to mitigate any local boiling of the fluid or bubble formation in contact with the substrate. For example, a circulating flow system using pump may be used as a fluid stirring mechanism. The circulating flow system may be pressurized by way of the pump and use gravity flow to form a complete closed system for agitating the fluid. Alternatively or additionally, a mechanical magnetic stirrer may be placed within the fluid containing tank to maintain fluid agitation as is well known to those skilled in the art.

In an alternate version of the plating/etching cell arrangement, a movable scraping or abrasion tool is provided to remove the offending coating by applying mechanical force to the substrate. The scraping or abrasion tool may be scanned across the substrate to remove the substrate's coating. Mechanical removal of the offending coating may be in addition or as an alternate to the heat-based removal (i.e., using the first voltage source or the energy source to remove the coating of the substrate in situ).

An exemplary scraping or abrasion tool may be a mechanical scribe with a sharpened end, which is placed in intimate contact with the substrate surface. In operation, the scribe mechanically penetrates the coating. The mechanical scribe may be driven by a motorized moveable arm, which is preferably computer controlled. As the scribe traverses the areal dimensions of the substrate, the coating is removed from the substrate surface. Removal of the coating allows plating and etching of the substrate surface to occur immediately thereafter, while the scribe and the substrate are submerged in the plating/etching solution or, alternatively, while the scribe and substrate are positioned in the preprocessing enclosure.

In some versions of the plating/etching cell arrangement in which the offending coating is removed within the plating/etching bath, the mechanical scribe may be used in conjunction with the first voltage source to remove a coating by application of both resistive (Joule) heating and mechanical force to the substrate surface. In such versions, the mechanical scribe may be made from conducting material, which allows localized current to flow from the scribe to the substrate. In a preferred embodiment of such a version of the plating/etching cell arrangement, the mechanical scribe is disposed to make contact with the back of the substrate (which may be sheet or flat stock). In this configuration, current that is supplied from the first voltage source flows through the substrate and heats the front of the substrate to remove the coating on the front surface of the substrate to be plated or etched (i.e. the surface facing the counter electrode).

The in situ plating/etching cell arrangements may be configured to operate with reel-to-reel material handling systems that are commonly used in industrial processing of long lengths of wire or sheet flat stock. In these reel-to reel material handling systems, the unprocessed substrates (i.e., long length of wire or sheet flat stock) are wound on a donor reel and fed into the processing fluid (tank fluid) by a series of support wheels. Processed substrates are similarly picked up by a series of wheels and wound on a mechanically driven take-up reel. The inventive in situ plating/etching cell arrangements may be provided with suitable scrapers for mechanically removing the offending coating on the substrate surface in situ in the processing fluid or in a small preprocessing enclosure in close proximity to the fluid. For example, the substrates may be driven or pulled through a die that removes the coating by way of a sharpened inner peripheral die surface (i.e. a knife edge). The substrate feed rate may be adjusted by suitably setting the speed of the reels. The substrate feed rate for the plating/etching processes may be selected so that the wire or flat stock substrates remain submerged in the plating/etching tank fluid for at least 0.1 s, as the substrates are pulled through the die using the mechanically driven take-up reel. The shape of the die (e.g., circular or rectangular) may be designed in consideration of the shape of the substrate material (e.g., wire or flat stock).

In some versions of the plating/etching cell arrangements, the die structures may be used in conjunction with the first source of voltage to apply heat to wire or flat stock substrates as they pass through the die. For example, opposite ends of a die may be used to pass current and to cause heating as the wire or flat stock passes through the die. This heating mechanism may be used as an alternate or an additional mechanism for removal of surface coatings. In another embodiment, heat may be generated directly in the wire or flat stock by contacting a voltage source by means of sliding contacts to the wire/flat stock directly, thereby using the resistance of the wire/flat stock in conjunction with current flow to generate the necessary heat to remove the coating.

After removal of surface coatings using the die, a second voltage can be applied to the wire or flat stock substrate across from a counter electrode to cause electroplating or electroetching.

Examples of plating/etching processes and cell arrangements are further described herein with reference to FIGS. 1*a*, 1*b*, 2-6, 8*a*-8*d*, 9, and 11-17.

FIG. 1*a* shows an exemplary plating/etching cell arrangement 100 for in situ removal of interfering surface coating during plating/etching of substrates 103 in a plating tank or vessel 101. Tank 101 contains an electrolyte 102, which can be either plating or etching bath. The substrate material to be plated or etched (i.e. substrate 103) is submerged in electrolyte 102.

In general, a plating bath may be an electroless, electroplating or immersion plating or other chemical solution. For etching, the bath may be a chemical etchant such as sodium hydroxide or any other etchant known to those skilled in the art. For electroetching, the etchant may, for example, be a copper sulfate solution. Plating/etching cell arrangement 100 may be provided with an optional counter electrode 104, which is used only for those applications that utilize either electroplating or electroetching. For immersion plating and electroless plating as well as for chemical etching, use of this electrode is unnecessary. A galvanostat 105 may provide the required electrolytic current for electroplating and electroetching. A simple voltage/current supply may also be used in its place. It will be understood that for electroless and immersion plating as well as for chemical etching, galvanostat 105 and counter electrode 104 need not be used.

As an initial step in the plating/etching process, a high current pulse is passed through substrate 103 using a first source of current/voltage (i.e. pulse generator 109). Pulse generator 109, which may be connected across opposite ends of substrate 103 by wires 110 and 111, supplies current pulses through substrate 103. Pulse generator 109 may be any suitable current source capable of generating current pulses, which, for example, have spans ranging from tens of pico seconds to continuous wave (CW). The current pulses may be designed to heat substrate 103 or its surfaces while it is immersed in 102. Substrates 103 or its surfaces may be heated sufficiently by the current pulses so that the interfering surface coating is removed. For electroplating and electroetching, a second source of voltage/current is provided by source 113. Source 113 may be utilized prior to the heating current pulse applied by pulse generator 109, concurrently, or at any time thereafter.

A fluid circulation system may be set up to agitate the fluid contained in tank 101 to avoid or prevent boiling or bubbling in the fluid at the surfaces of substrate 103, which may be induced by localized heating caused by passage of the current pulse. The circulation system may include a pump 106 with an input 107 to tank 101, and a drain 108.

Figure 1B:
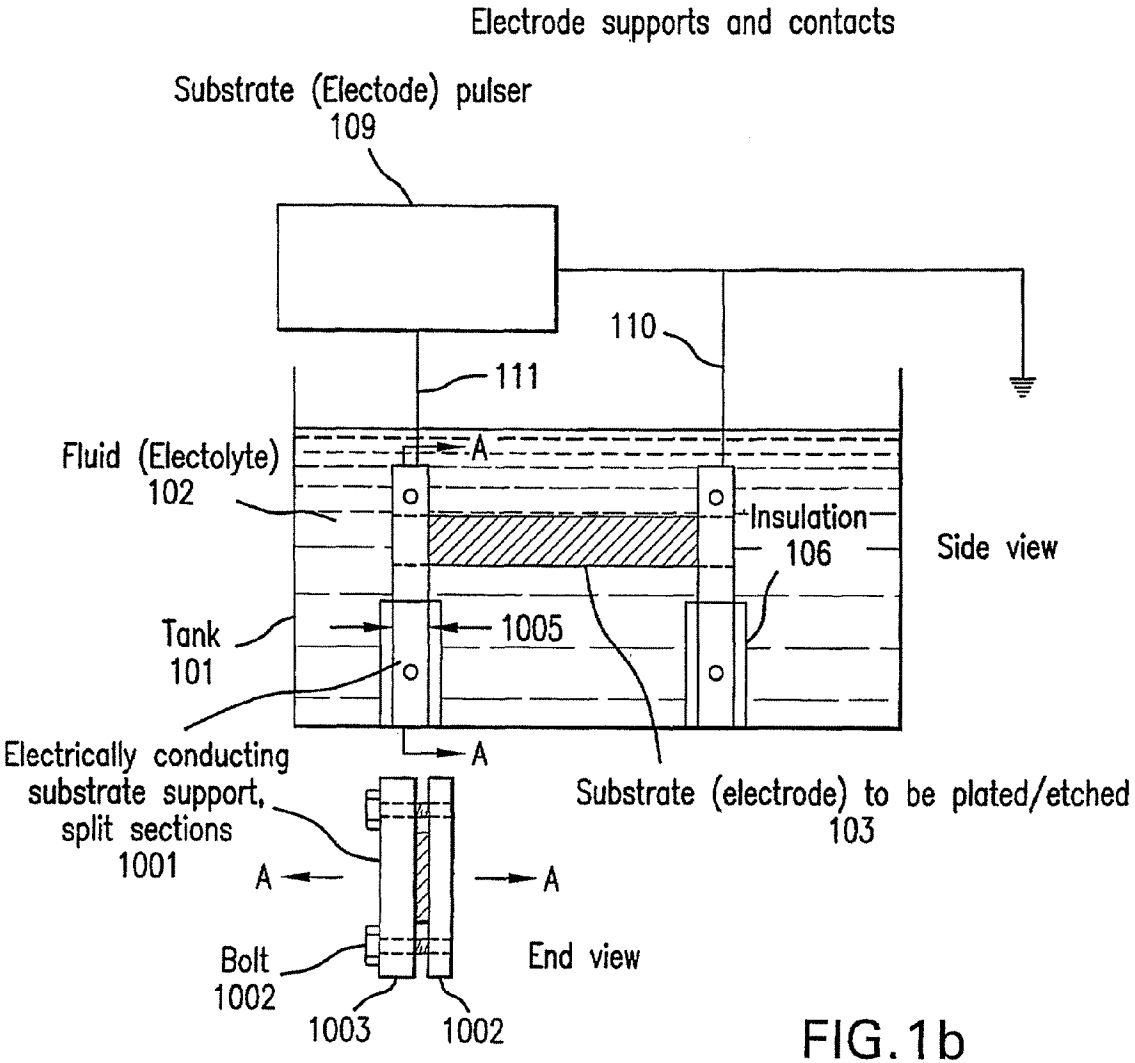
FIG. 1*b* schematically illustrates details of exemplary electrical contacts and the electrode support structures for the cell arrangement of FIG. 1*a*, in accordance with the principles of the present invention.

FIG. 1*b* shows a more detailed view an exemplary fixture assembly designed to hold substrate 103 in tank 101. The fixture assembly includes a pair of metallic posts 1001, each of which is made from two separate metal sections 1003 and 1004. Metal sections 1003 and 1004 may be rectangular in shape and may be held together by mechanically (e.g., by bolts 1002 with 1003 clamped between sections 1003 and 1004). Metallic posts 1001 may be fastened to a base plate (not shown) that allows posts 1001 to rest on the bottom of tank 101. Pulser 109 may be electrically connected to substrate 103 by a pair of connecting wires 110 and 111 running along substrate support posts 1001. A similar fixture assembly may be used to hold counter electrode 104 when such an electrode is used. The dimensions of metal sections 1003 and 1004 may be selected so that their widths 1005 are small compared to the distance between them. Posts 1001 may have any suitable thickness (e.g., of the order of 1-5 mm). Posts 1001 may be made of material, which preferably has high electrical conductivity (e.g., copper posts for copper plating/etching). An insulating sleeve may enclose portions of post 1001 below substrate 103 to avoid plating or etching of post 1001 itself. It will be understood that the fixture assembly shown in FIG. 1*b* is exemplary, and that one skilled in the art can readily design alternative fixture assemblies.

Figure 2:
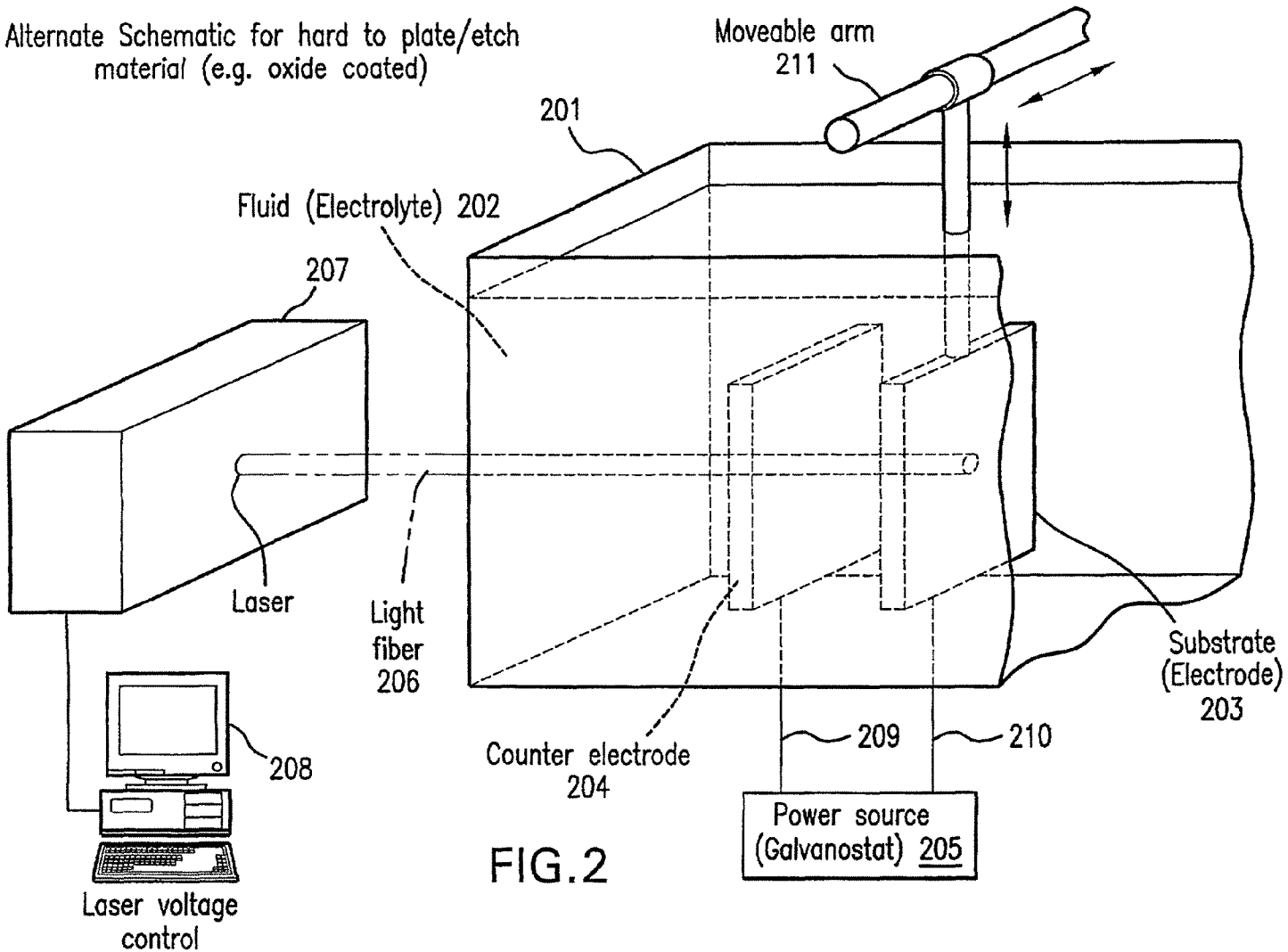
FIG. 2 is a schematic illustration of another exemplary plating/etching cell arrangement, which is configured for removal of an interfering insulating surface film by laser light treatment just prior to or during the metal plating or etching of a subject substrate, in accordance with the principles of the present invention. The plating/etching cell arrangement includes a moveable holder for moving the substrate relative to the laser light so that different surface portions of the substrate can be treated sequentially.

FIG. 2 shows another exemplary plating/etching cell arrangement 200, in which a laser 207 is exploited to irradiate substrate 203 to be etched or plated. In plating/etching cell arrangement 200, substrate 203 may be at least partially submerged in an electrolyte or other plating/etching solution 202 contained within a tank 201. A counter electrode 204 for electroplating and electroetching is also submerged in solution 202 in tank 201. A galvanostat or other voltage/current supply 205 may be connected via wires 209 and 210 to impose an electric potential difference between counter electrode 204 and substrate 203. Counter electrode 204 and galvanostat 205 are not used when plating/etching cell arrangement 200 is used for electroless, immersion plating or chemical etching of substrate 203.

Laser 207, which is disposed external to tank 201, may be configured so that its output light is directed into a light pipe or light fiber 206 extending into tank 201. Light fiber 206 may be suitably oriented so that the laser light output is incident on substrate 203. Laser 207 may be suitably pulsed to generate light pulses with pulse widths (e.g., ranging from a few ps to hundreds of microseconds). For some applications longer pulses extending to cw operation may be used. A laser voltage control unit 208 may be used to set the pulse width and pulse intensity of laser 207. Laser 207 may have a laser wavelength in the range of about 0.1-10 micrometers. Laser 207 may, for example, be a near infrared or infrared laser emitting radiation at wavelengths that are suitable for absorption in and heating of the substrates. The intensity and duration of the laser light incident on substrate 203 may be theoretically or empirically designed to remove coatings from the surface of substrate 203 by heating. The coatings/substrate may be sufficiently heated to bring about coating removal by ablation, differential expansion of the coating and the substrate leading to cracking of the coating, melting or any by other mechanism. Alternatively, laser 207 may be an ultraviolet laser emitting radiation at wavelengths that are suitable for photoablative decomposition and removal of the inhibiting layer without substantial heating of the substrates.

Substrate 203 may be mounted on a moveable arm 211 assembly, which may be operated by a computer (not shown) to move substrate 203, for example, in vertical and horizontal directions. By coordinating the pulsing of laser 207 with the movement of substrate 203, patterned coating-removal, plating or etching of substrate 203 can be obtained. The degree of etching or plating of substrate 203 may be controlled by varying the intensity of laser 207, for example, by using voltage control unit 208 after the coating has been removed. Additional contrast in the pattern on substrate 203 may be achieved by making counter electrode 204 comparable in diameter to that of light fiber 206 to limit the region of plating as a function of position of substrate 203. Suitable contrast in the electroplating/etching patterns on substrate 203 also may be obtained by controlling the voltage between counter electrode 204 and substrate 203 as arm 211 is set into motion. For this purpose, galvanostat 205 may be programmed using any suitable computer or microprocessor (not shown). Laser light from laser 207 may also be aimed directly at the substrate 203 without the use of fiber 206.

Figure 3:
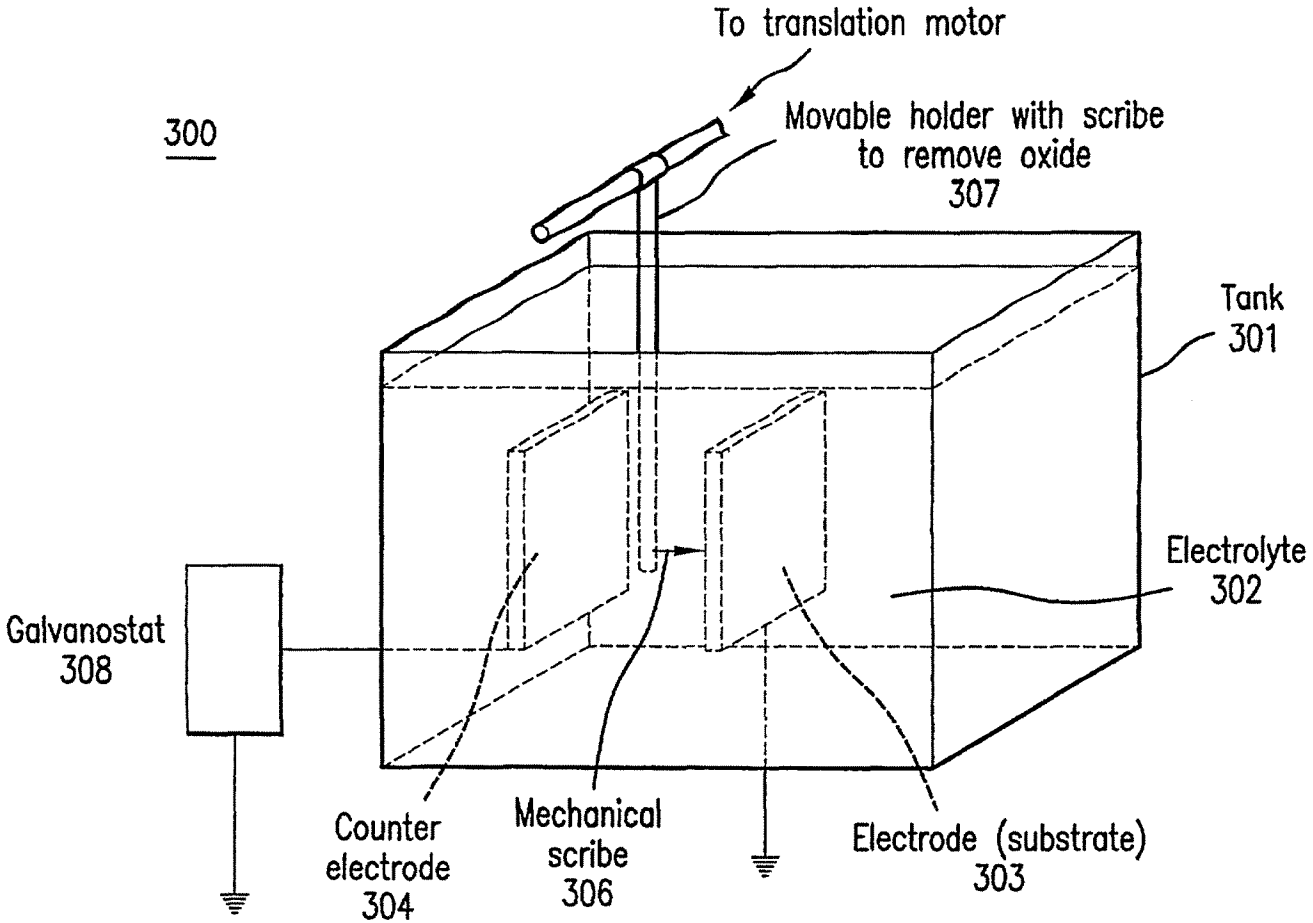
FIG. 3 is a schematic illustration of yet another exemplary plating/etching cell arrangement, which is configured for in situ removal of an interfering insulating surface film by mechanical treatment during the metal plating or etching of a subject substrate, in accordance with the principles of the present invention. The plating/etching cell arrangement includes a scratching or scraping tool for mechanically removing the interfering insulating film from the substrate while the substrate is at least partially submerged in an electrolyte or other plating/etching fluid.

FIG. 3 shows another exemplary plating/etching cell arrangement 300, in which a sharp probe or pointed scribe 306 is used to remove the surface coatings on substrate 303, while the latter is submerged in the plating/etching solution 302 in tank 301. Solution 302 may be an electrolyte or a process liquid used to cause plating or etching for cases where no external voltage need be supplied to a counter electrode. In tank 301, electrolyte (or process liquid) 302 at least partially covers substrate 303. Sharp probe or pointed scribe 306 may be mounted on moveable arm 307, which can be set in motion by a translation motor and computer (not shown). Sharp probe or pointed scribe 306 may be spring loaded or biased so that it is in mechanical contact with substrate 303. The contact pressures may be suitably set so that movement of scribe 306 across the surface of substrate 303 by arm 307 results in removal of coating or oxide layers on substrate 303.

In plating/etching cell arrangement 300, an optional counter electrode 304 is attached to a galvanostat or voltage/current supply 305. For electroplating or electroetching of substrate 303, a voltage can be applied between counter electrode 304 and substrate 303 before, during, or after moving scribe 306 along the surface of the substrate 303. It will be understood that for electroless, immersion plating and chemical etching processes, galvanostat 305 and counter electrode 304 are not needed or activated.

Figure 4:
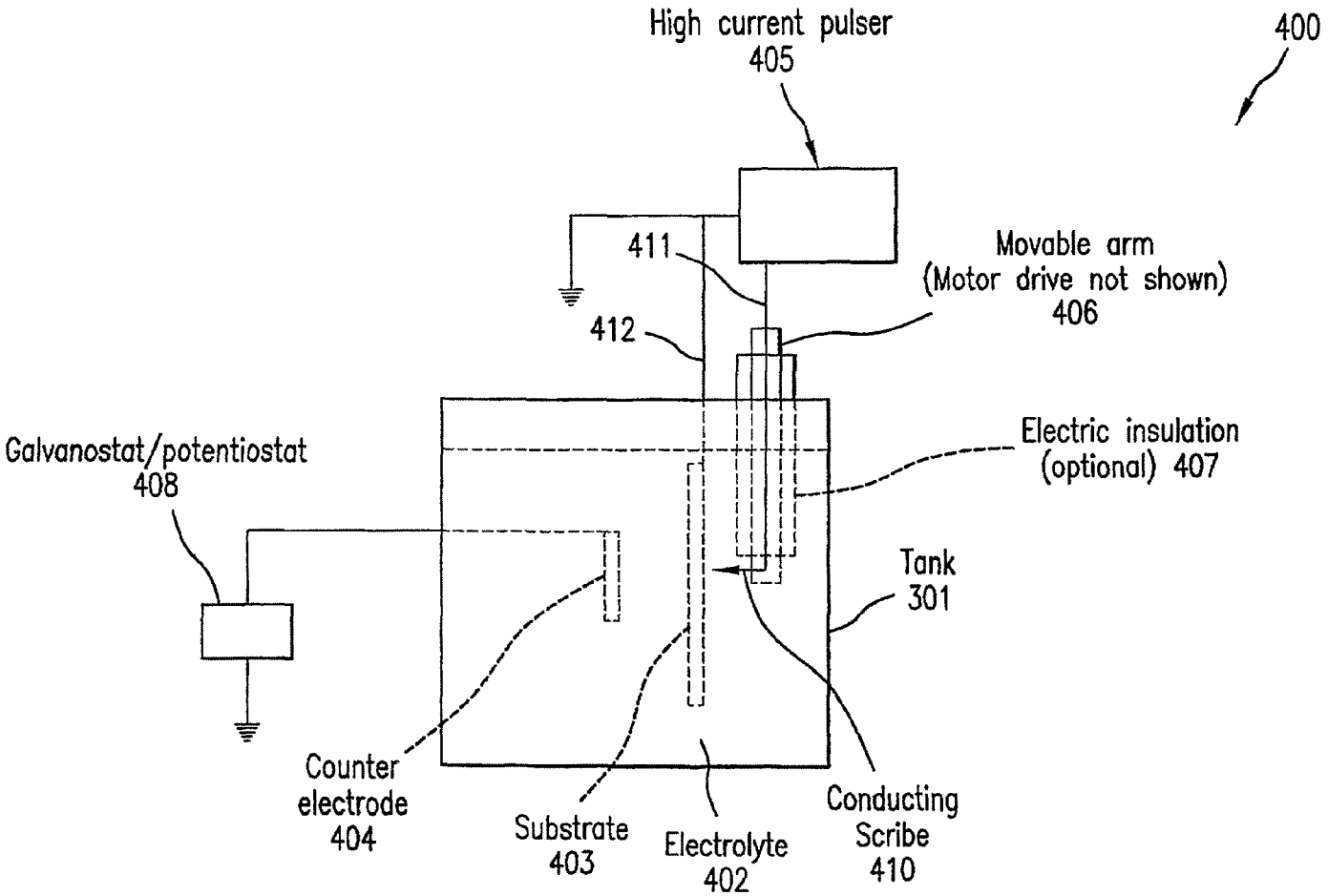
FIG. 4 is a schematic illustration of the plating cell arrangement of FIG. 3, which has been additionally configured to apply heat to the substrate facing away from the counter electrode, in accordance with the principles of the present invention.

FIG. 4 shows another plating/etching cell arrangement 400, in which a sharp probe or pointed scribe 410 is used to deliver an electrical current generated by a high current pulser 405 for passage through substrate 403 (and its surface coatings), while the latter is submerged in the plating/etching solution 402 in tank 401. The electrical current pulses may be designed to dissipate and resistively heat the surface coatings on substrate 403 to induce their removal.

In plating/etching cell arrangement 400, pointed scribe 410 is spring loaded and may rest on either the front or back surface of substrate 403. In the example shown, pointed scribe 410 rests on the back surface of substrate 403. Further, pointed scribe 410 may be mounted on moveable arm 406 so that it can be moved along the surface of substrate 403 in a controlled manner (using, for example, a controller and computer (not shown)). An optional insulation material 407 may cover portions of moveable arm 406 to isolate those portions electrically or chemically. As arm 406 together with spring loaded scribe 410 is moved along the back of substrate 403, a pulser 405 can deliver a pulse of current or a cw current (depending on the settings of pulser 405) through scribe 410. For this purpose, current pulser 405 may be connected to pointed scribe 410 and to substrate 403, by connecting wires 411 and 412, respectively. The current transmission through the point of contact of scribe 410 on the back of substrate 403 results in localized heating to remove localized regions of coating on both the front and back surface of 403.

Counter electrode 404, which faces the front surface of substrate 403, may be operated in conjunction with galvanostat or voltage source 408 at any time during the coating removal process to cause plating or etching of front surface regions of substrate 403. These front surface regions correspond to regions of the back of substrate 403 where scribe 410 has delivered current. It will be understood that for electroless, immersion plating and chemical etching, galvanostat 408 and counter electrode 404 are not needed or activated.

Figure 5:
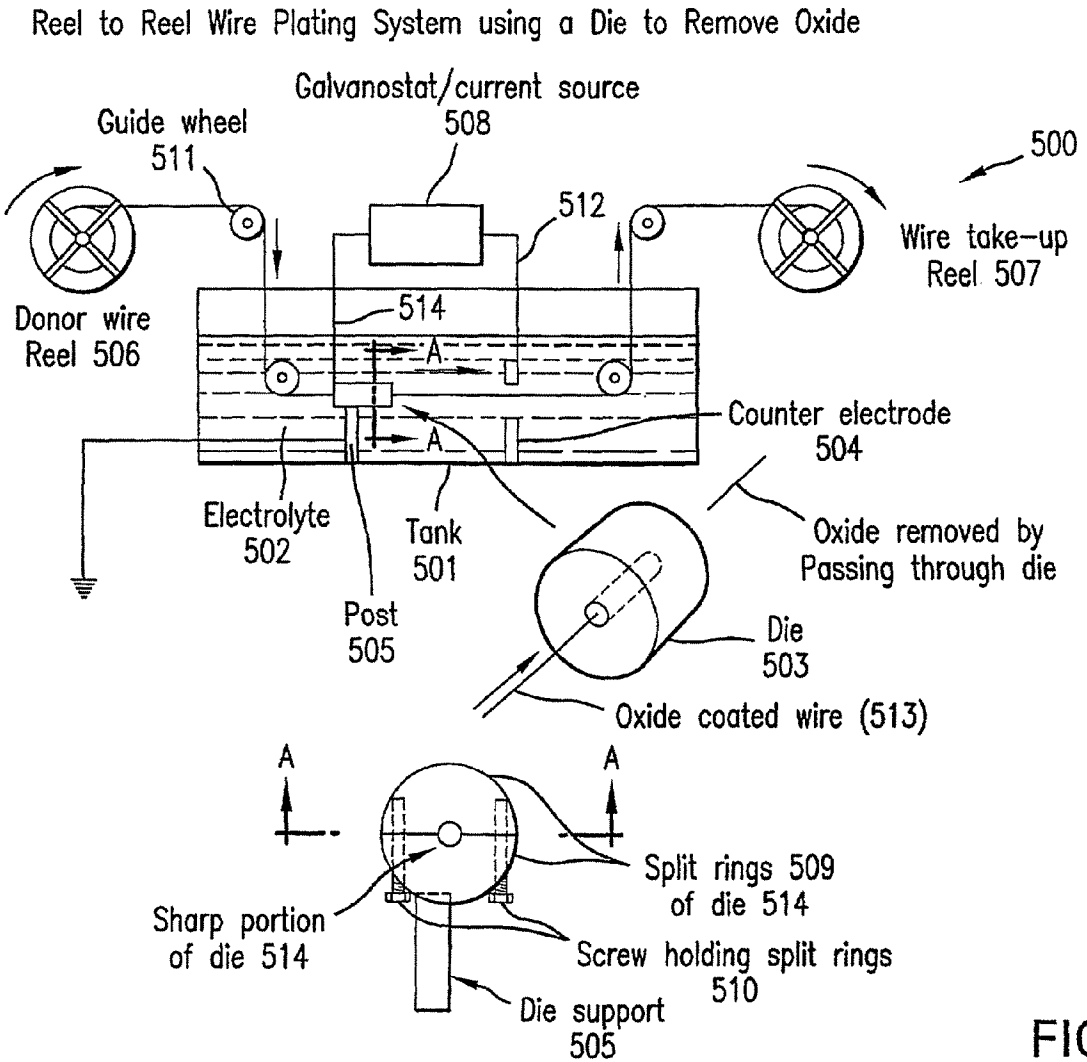
FIG. 5 is a schematic illustration of an exemplary plating/etching cell arrangement, which is configured for removal of an interfering surface film on a wire substrate by in situ mechanical stripping during metal plating or etching of the wire substrate, in accordance with the principles of the present invention. The wire substrate, which may be supplied and picked up in a reel-to-reel arrangement, is passed though a knife-edge die which strips the interfering surface film, while submerged in an electrolyte or other plating/etching fluid.

The plating/etching cell arrangements may be adapted for use with common industrial material handling systems (e.g., reel-to-reel systems for wire and flat stock substrates). FIG. 5 shows a plating/etching cell arrangement 500, which is configured for processing wire substrates 513. Plating/etching cell arrangement 500 includes a tank 501 for holding electrolyte or other plating/etching chemical solutions 502. A die with a sharp inner edge 503 rests on a die support post 505 within tank 501. Coated or partially coated (e.g., oxidized) wire substrate 513, which is used as raw material, is wound on a donor reel 506. From reel 506, wire 513 is guided by a set of guide wheels 511 into tank 501 containing processing fluids or solutions (e.g., electrolyte 502). Wire 513 is pulled or drawn through a die 503 having knife-edges for stripping or scraping undesirable coating material from the wire substrate surface. An exemplary annular design of die 503 is shown in the inset in FIG. 5. Exemplary die 503 may have split annular rings 509, which are clamped (e.g., with one or more screws 510) around wire substrate 513. Wire substrate 513, which is passed through die 503, also may be passed through a similar hole or opening in counter electrode 504 (for applications involving electroplating or electroetching) to facilitate continuous movement of wire substrate 513 through tank 501. Additional guide wheels 511 may direct processed wire substrates 513 out of tank 501 onto a take-up reel 507. Die 503 may have a sharp inner circumferential portion (e.g. a knife edge 514) designed to scrape the surface of passing wire substrate 513 to remove any surface coatings so that unhindered plating or etching of the wire substrate material can take place. The rate at which wire substrate 513 is processed through plating/etching cell arrangement 500 may depend in part on the rotation speeds of reels 506 and 507. The rotation speeds of reels 506 and 507 may be controlled, for example, by a computer-controlled drive motor (not shown) or by any other suitable conventional mechanical mechanisms. For electroplating and electroetching processes conducted in plating/etching cell arrangement 500, a galvanostat 508 (or any other suitable current/voltage source) may be connected to the die 513 and a counter electrode 504 using connecting wires 514 and 512, respectively.

Figure 6:
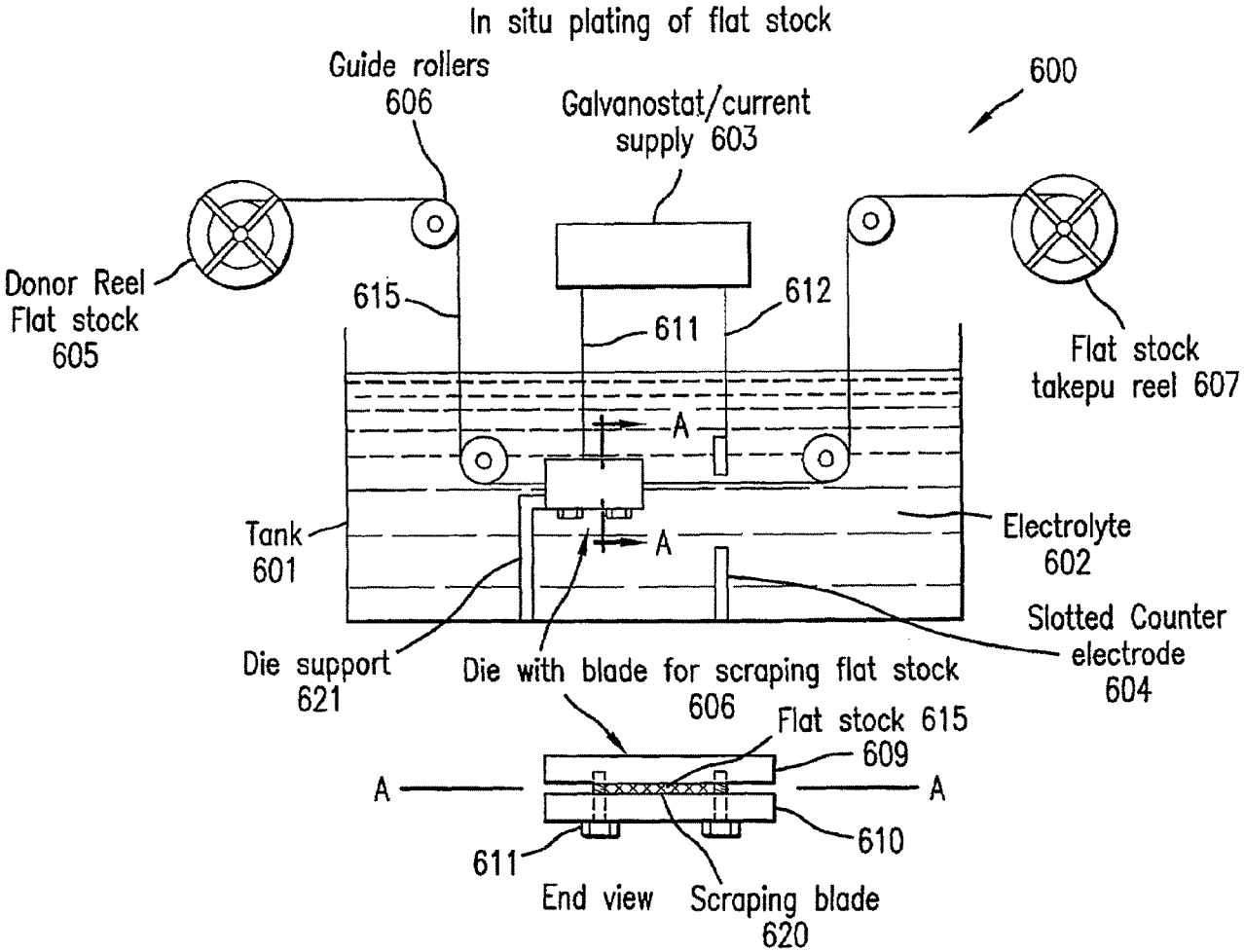
FIG. 6 is a schematic illustration of another exemplary plating/etching cell arrangement, which is configured for in situ mechanical stripping of an interfering film on flat stock substrate during metal plating or etching of the flat stock substrate, in accordance with the principles of the present invention. The flat stock substrate is passed though a knife-edge die, which strips the interfering surface film, while the flat stock substrate is submerged in an electrolyte or other plating/etching fluid.

FIG. 6 shows a plating/etching cell arrangement 600, which is configured for processing flat stock substrate 615. Plating/etching cell arrangement 600 includes a tank 601 for holding electrolyte or other plating/etching fluid 602. A die with a sharp inner edge 603 rests on a die support post 605 within tank 601. Coated or partially coated (oxidized) flat stock substrate 615 may be fed from a donor reel 605 over a set of guide rollers 606 into tank 601. In tank 601, flat stock substrate 615 is pulled or driven through a die 608 with a rectangular opening. Die 608 may be mounted on support 621 disposed on the bottom of tank 601. Die 608 may have knife-edges or blades disposed in the rectangular opening for stripping or scraping undesirable coating material from the flat stock substrate surface. For electrolytic plating or etching processes, the cell arrangement 600 may be provided with a slotted counter electrode 604 to facilitate passage of processed flat stock substrate 615 through tank 601 onto take-up reel 607. A galvanostat (voltage/current source) 603 may be connected to die 608 and counter electrode 604 by suitable wires 611 and 612, respectively.

An exemplary design of die 608 is shown in the inset in FIG. 6. Die 608 may be assembled from two split sections 609 and 610 that are held together by bolts 611. The dimensions of the rectangular opening in die 608 may be selected so that scraping blade 620 acts against the surface of flat stock substrate 615 passing through the opening and mechanically removes coating or oxide materials, which may be present on the surface.

In some applications, die 503 and die 608 in plating/etching cell arrangements 500 and 600, respectively, may additionally or alternatively be employed as heaters to provide energy pulses for heat removal of the coating or oxides on the in-process wire or flat stock substrates. In such applications, the dies may be suitably modified and connected to a voltage/current source to deliver current pulses to the substrate, for example, in a manner similar to the one previously described with reference to plating/etching cell arrangement 100 (FIG. 1*a*).

Figure 7:
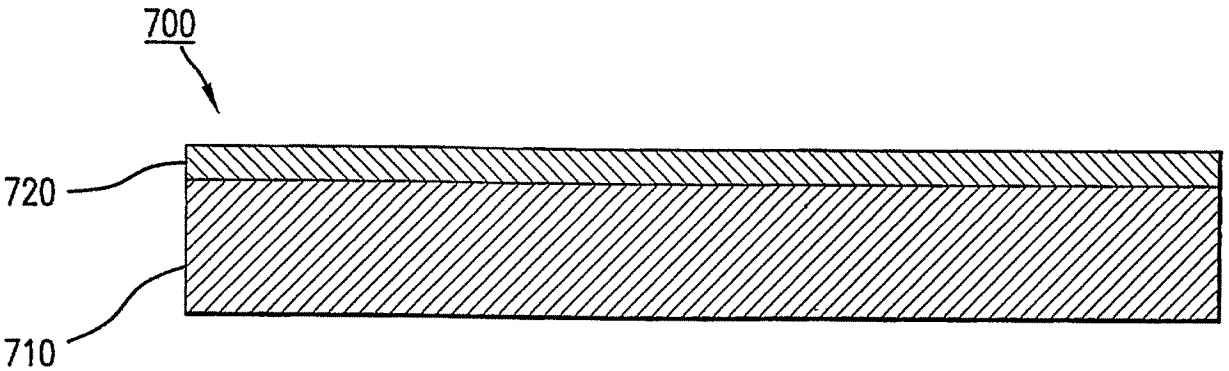
FIG. 7 is a schematic illustration of a metal-plated article made from a refractory metal substrate in which the metal plating layer is bonded directly to the substrate material without any intervening substrate modification or seed layers, in accordance with the principles of the present invention.

FIG. 7 shows in partial cross-section the layered structure of a metal-plated article 700, which may be fabricated using, for example, plating/arrangement 600. Metal-plated article 700 includes a flat stock substrate core 710 made of readily oxidizing material (e.g., aluminum or a refractory metal). A metal plated layer 720 is disposed directly on the surfaces of core 710, any inhibiting or interfering surface coating having been removed. Metal plated layer 720 may be any desired plating material (e.g. nickel, silver, gold, copper, cadmium, etc.).

It will be understood that metal plated layer 720 may be formed by exchange plating from the chemical solution, which can take place after in-situ removal of inhibiting or interfering surface coatings by application of heat pulses or abrading action (FIGS. 1-7). Additional electroplating using a voltage supply or potentiostat may not be required when the usually very thin coatings obtained by exchange plating are sufficient, for example, by design of metal-plated article 700.

Figure 8A:
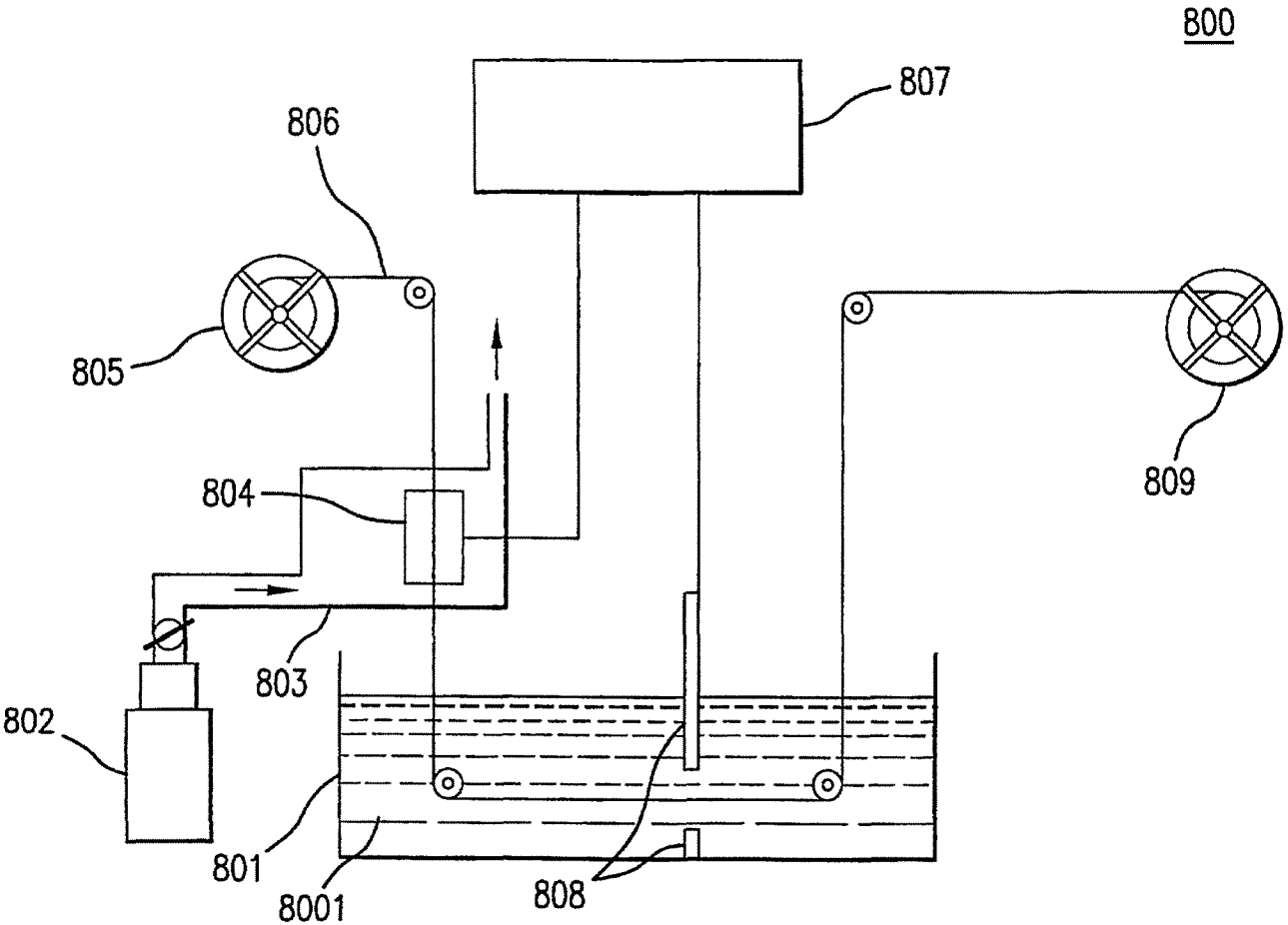
FIG. 8*a* is a schematic illustration of an exemplary plating/etching cell arrangement including a coating-removal enclosure in which inhibiting surface films are mechanically removed from substrate surfaces prior to immersion in a plating or etching bath, in accordance with the principles of the present invention. The coating-removal enclosure may be supplied with an inert or reducing gas atmosphere, and is compatible with reel-to-reel substrate supply and pick-up arrangements.
Figure 8B:
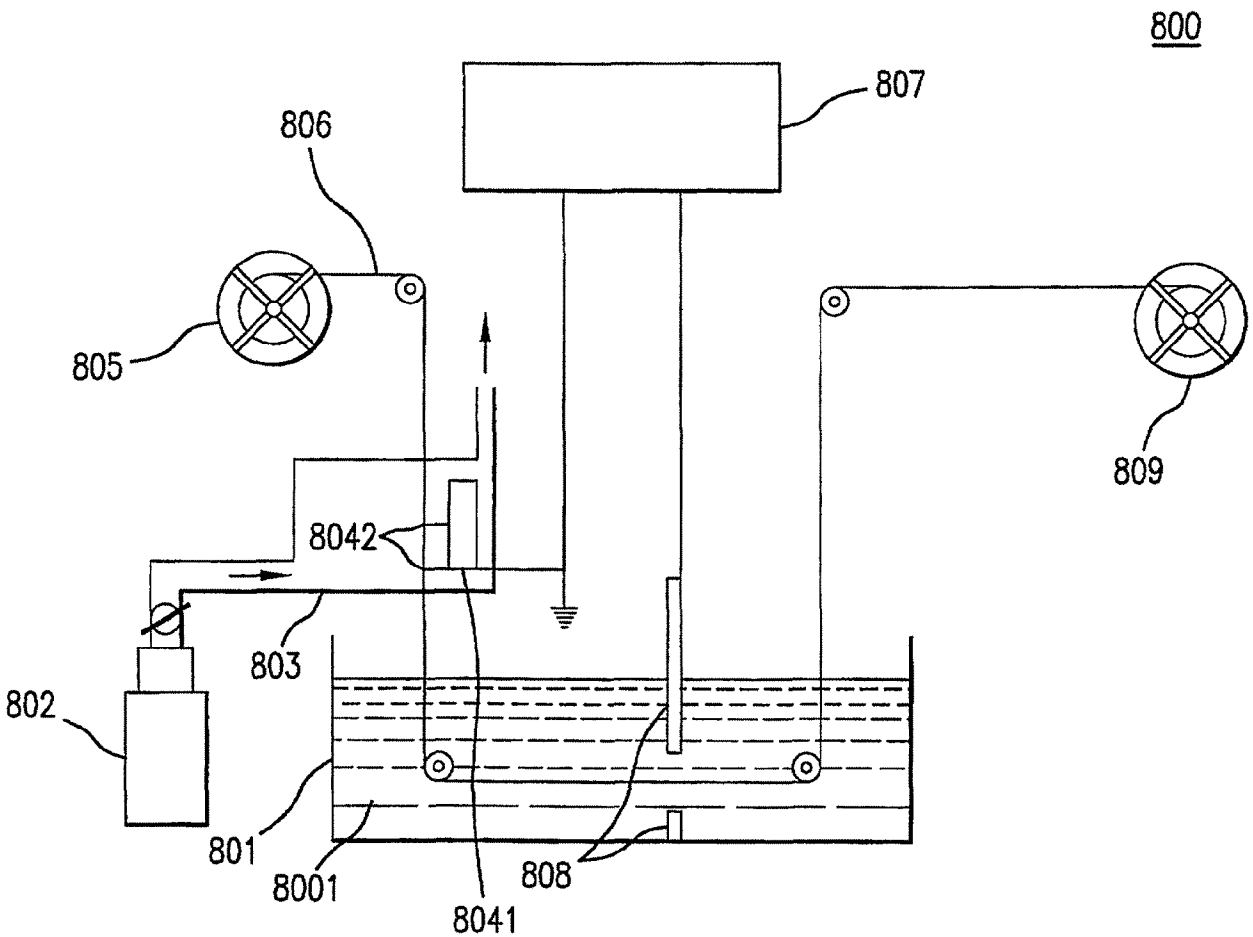
FIG. 8*b* is a schematic illustration of another exemplary plating/etching cell arrangement including a coating-removal enclosure in which substrates are electrically heated in an inert or reducing ambient to remove inhibiting surface films prior to immersion in a plating or etching bath, in accordance with the principles of the present invention. Like the coating-removal enclosure of FIG. 8*a*, the enclosure of FIG. 8*b* is compatible with reel-to-reel substrate supply and pick-up arrangements.
Figure 8C:
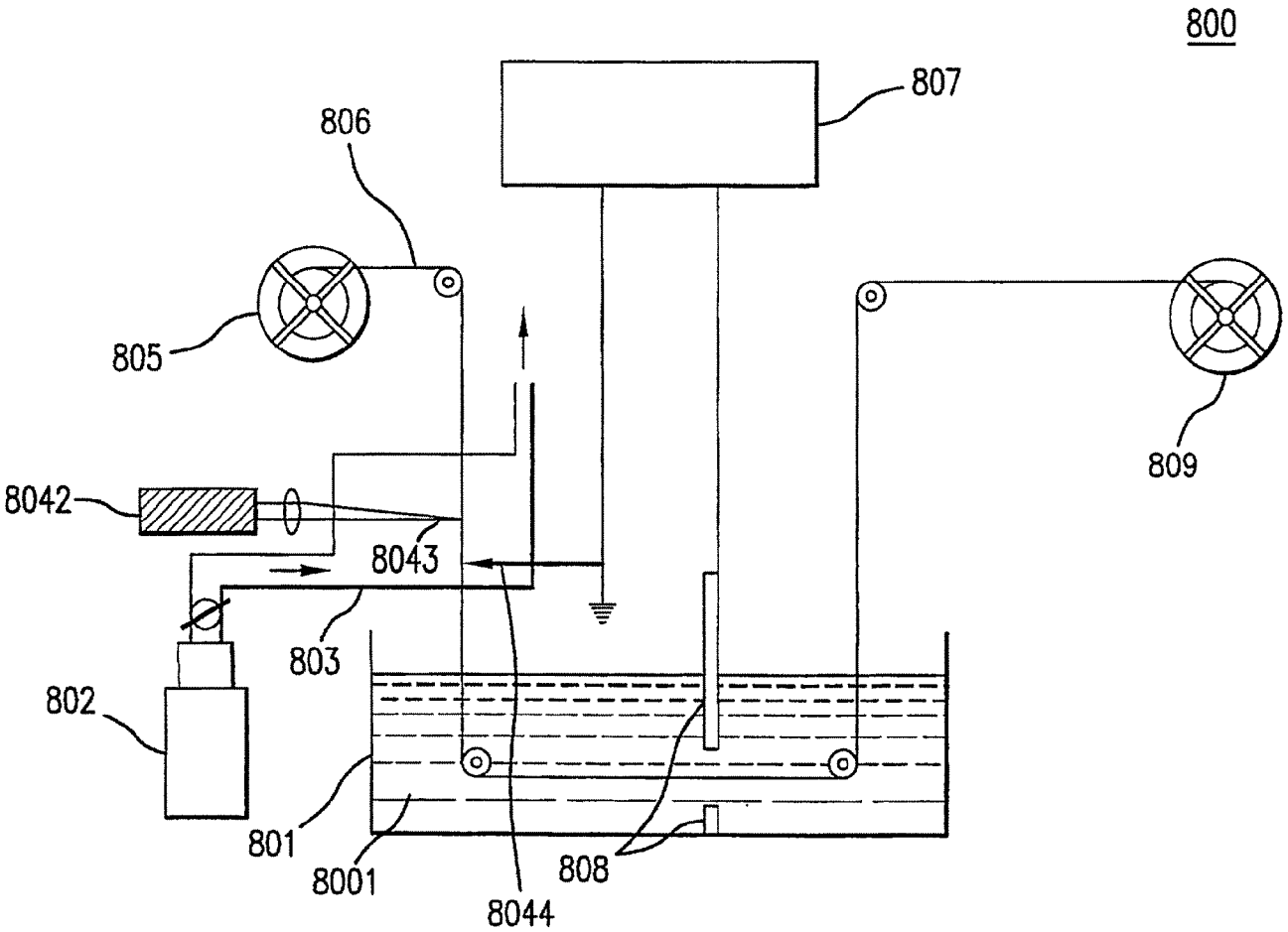
FIG. 8*c* is a schematic illustration of yet another exemplary plating/etching cell arrangement including a coating-removal enclosure in which a substrate is laser irradiated in an inert or reducing ambient to remove inhibiting surface films prior to immersion in a plating or etching bath, in accordance with the principles of the present invention. Like the coating-removal enclosures of FIGS. 8*a* and 8*b*, the enclosure of FIG. 8*c* is compatible with reel-to-reel substrate supply and pick-up arrangements.
Figure 8D:
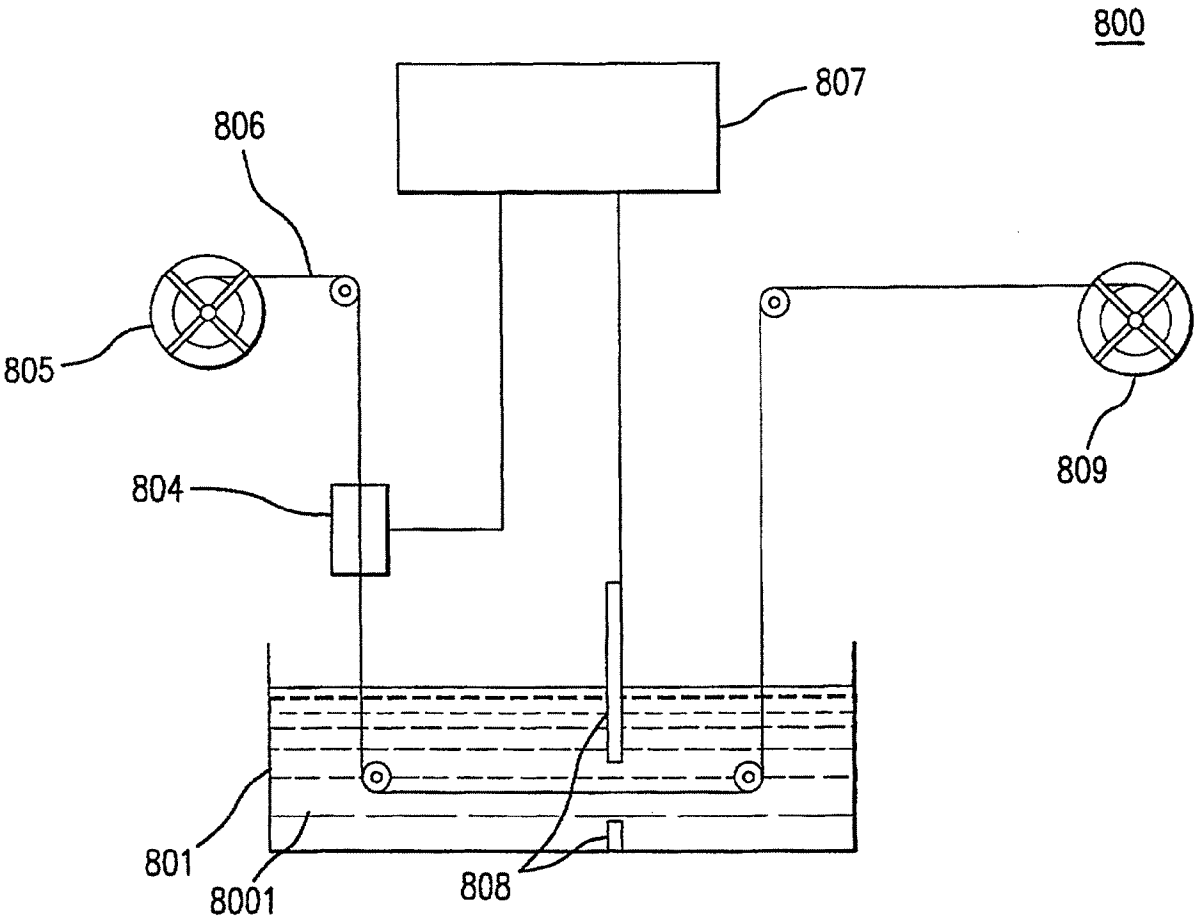
FIG. 8*d* is a schematic illustration of an exemplary plating/etching cell arrangement in which inhibiting surface films are mechanically removed from the substrate surfaces in air prior to immersion in a plating or etching bath, in accordance with the principles of the present invention. The cell arrangement is configured with a reel-to-reel substrate supply and pick-up arrangement.

FIGS. 8*a*-8*d* and 9 show plating/etching cell arrangements 800 and 900, in which coating removal steps are performed before the substrates are immersed in plating/etching baths 801 and 901, respectively. These arrangements may include controlled atmosphere enclosures 803 or 903 in which the coating removal steps and/or other substrate preprocessing steps may be performed. The enclosures may be in close physical proximity to the plating/etching baths (e.g., enclosure 803 FIGS. 8*a*-8*c*) or mounted directly on the plating/ etching baths (enclosure 904, FIG. 9). FIG. 8*d* shows a plating/etching cell arrangement 800 in which a mechanical coating removal step can be performed in ambient air just prior to immersion of the substrate in the plating/etching bath 800.

With reference to FIG. 8*a*, plating/cell arrangement 800, which includes a plating/etching bath tank 801 holding an electrolyte 8001 and a controlled atmosphere enclosure 803, is configured for operation with a reel-to-reel substrate material handling system. The material handling system may include supply and pick-up reels 805 and 809, respectively. Raw wire or flat stock 806 unwound from supply reel 805 is passed through enclosure 803 before being processed in plating/etching bath tank 801 and being rewound on pick-up reel 809. The walls of enclosure 803 may be provided with slots or openings of suitable dimensions (not shown) to accommodate the passage of raw wire or flat stock 806 through enclosure 803. A mechanical abrasion die 804 may be located in enclosure 803 to provide the necessary mechanical contact with wire or flat stock 806 to remove the unwanted coating from the surfaces of stock 806, for example, by friction. The atmosphere in enclosure 803 may be controlled during the coating removal processes. Inert or non-oxidizing atmospheres made of gases such as nitrogen, helium, or argon may be desirable to prevent or hinder reoxidation of cleaned substrate surfaces. The suitable specific gas or gases may be supplied from a gas source 802 connected to enclosure 803. In operation, undesired coatings are stripped from the surface of wire or flat feed stock 806 in enclosure 803 by mechanical die 804 so that stock 806, which passes into plating/etching bath 801, has a clean surface.

Mechanical abrasion die 804 also may serve as an electrical contact to wire or flat stock 806. A voltage source or potentiostat 807 connected to abrasion die 804 may be used to apply an electrical voltage to wire or flat stock 806 across from counter electrode 808 to obtain electroplating or etching action as coating-free wire or flat stock 806 passes through electrolyte 8001. Processed wire or flat stock 806 is drawn out of electrolyte 8001 and wound on pick-up reel 809.

FIG. 8*b* shows a variation of the plating/etching cell arrangements 800 in which mechanical abrasion die 804 is replaced by a heating arrangement 8041. Heating arrangement 8041 is configured to make a pair of electrical contacts 8042 with wire or flat stock 806 as the stock passes through enclosure 803. A voltage applied across the pair of electrical contacts 8042 by heating arrangement 8041 causes an electrical current to flow through the intervening section of stock 806. The magnitude of the electrical current may be suitably selected to cause sufficient resistive or Joule heating to remove the unwanted coating/film from the surfaces of stock 806. The heating process may be conducted in an inert gas atmosphere, which is supplied from gas tank 802, to minimize surface oxidation or reoxidation.

FIG. 8*c* shows another variation of plating/etching cell arrangement 800 in which laser heating is employed instead of mechanical abrasion or Joule heating to remove unwanted coatings from the surface of wire or flat stock 806 passing through enclosure 803. A laser 8042 may be deployed to direct light onto wire or flat stock 806 passing through enclosure 803. Laser 8042 may be selected to have a light wavelength suitable for absorption in and consequent heating of the stock material or absorption in the inhibiting film itself giving rise to photoablation of the inhibiting film. In operation, laser 8042 may be operated at a power sufficient to heat wire or flat stock 806 so that unwanted surface coatings are removed as wire or flat stock 806 moves through enclosure 803. Voltage source or potentiostat 807 may be configured to make a sliding electrical contact 8044 with wire or flat stock 806 as the stock passes through enclosure 803. Voltage source or potentiostat 807 may be used to apply an electrical voltage to wire or flat stock 806 across from sliding contact 8044 and counter electrode 808 to obtain electro plating or etching action as coating-free wire or flat stock 806 passes through electrolyte 8001.

In another implementation of plating/etching cell arrangement 800, removal of unwanted surface coatings may be accomplished by chemical action. In such an implementation, enclosure 803 may be configured to hold a reducing gas atmosphere (e.g., hydrogen) to treat the surfaces of passing wire or flat stock 806 to remove unwanted coatings.

It will be understood that in FIGS. 8*a*-8*c*, enclosure 803 is shown as separated from tank 801 by an arbitrary distance, which is selected only for visual clarity in illustration. In practical implementations of plating/etching cell arrangements 800, enclosure 803 may be separated from tank 801 by a distance selected in consideration of the tolerable transit time of cleaned stock 806 through air prior to plating or etching action. In some implementations, enclosure 803 may be attached to tank 801 so that cleaned wire or flat stock 806 can exit directly into tank 801. Such implementations minimize the time cleaned wire or flat stock 806 is exposed to air before submerging in electrolyte 8001.

Conversely, for certain applications in which air exposure times are not a significant issue (e.g., the plating or etching of cleaned aluminum), enclosure 803 may be completely dispensed with. FIG. 8*d* shows a plating/etching cell arrangement 800, which is configured for processing materials such as aluminum. In this configuration, surface coatings may be adequately removed from aluminum wire or flat stock 806 by mechanical die 804 in air without the benefit of a controlled atmosphere of enclosure 803. It will be understood that mechanical die 804 is placed in close proximity to tank 801.

Figure 9:
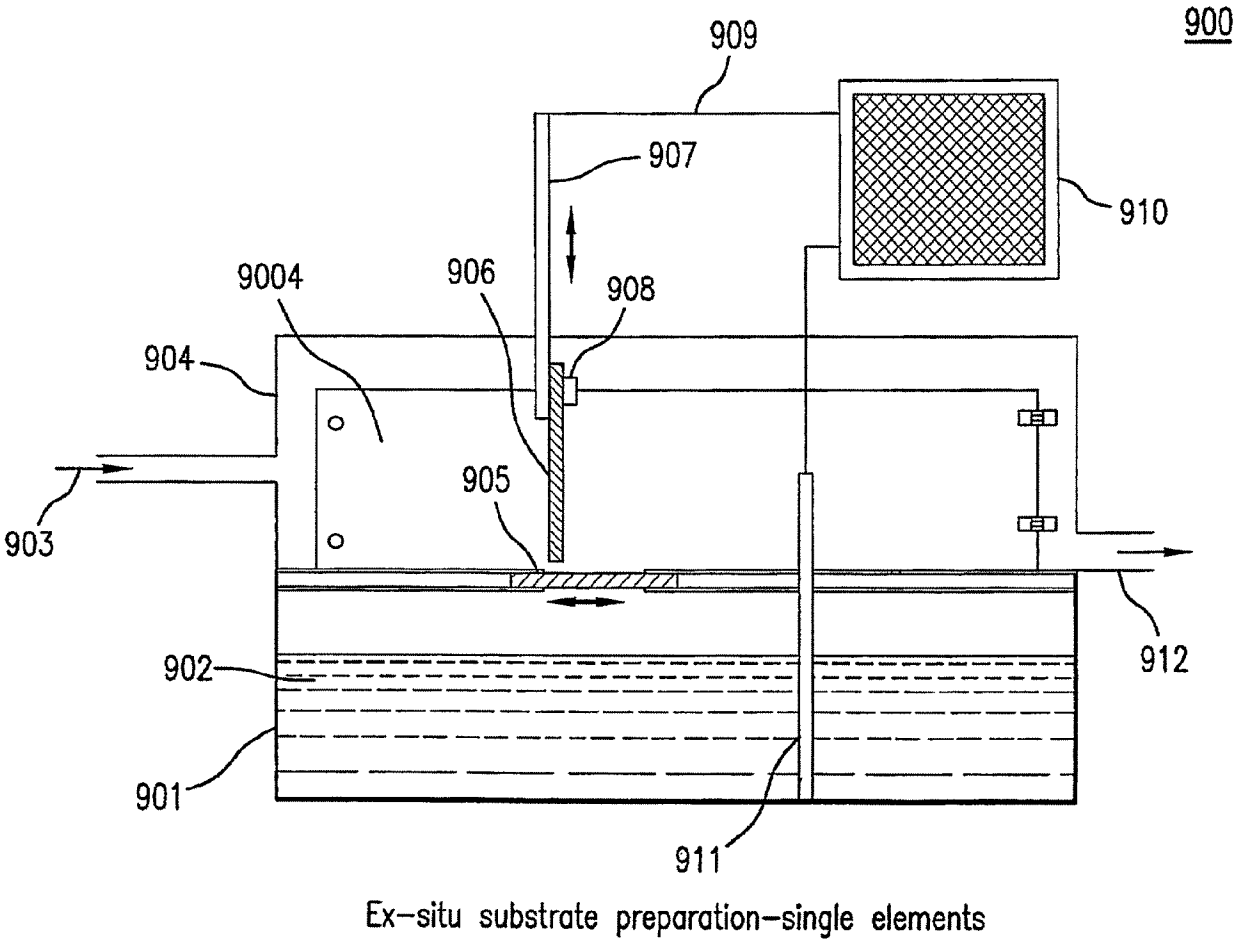
FIG. 9 is a schematic illustration of still another exemplary plating/etching cell arrangement including a coating-removal enclosure in which a substrate may be treated to remove inhibiting surface films prior to immersion in a plating or etching bath, in accordance with the principles of the present invention. The coating removal enclosure is mounted directly above the plating/etching bath and may be configured to treat individual substrate pieces one by one, or to treat a continuous reel-to-reel supply of substrates.

FIG. 9 shows another plating/etching cell arrangement 900, which is adapted for processing substrates that are not conveniently supplied by reel-to-reel material handling systems. The substrates may be discrete individual parts or parts having non-flat geometrical shapes. Plating/etching cell arrangement 900 is designed so that unwanted surface coatings can be removed from substrate 906 having any arbitrary shape prior to etching and plating. Plating/etching cell arrangement 900 includes a tank 901 which can hold an electrolyte 902. An enclosure 904, which has a substrate loading door 9004, is disposed directly atop tank 901. Enclosure 904 is provided with ports 903 and 912 that may be used to flow gases through the enclosure. A sliding access door 905 may be provided between enclosure 904 and tank 901. Substrate 906 may be loaded through loading door 9004 and attached by fastener 908 to substrate holding rod 907, which may be adapted for controlled vertical motion to position loaded substrate 906 in either enclosure 904 or tank 901. Rod 907 is also connected to a terminal of voltage supply or potentiostat 910 by way of a wire lead 909.

In preparation for plating or etching in tank 901, substrate 906 is first suspended in enclosure 901. A reducing gas (e.g., hydrogen) may be passed over substrate 906 through ports 903 and 912 to chemically reduce and remove unwanted surface coatings. After removal of the unwanted surface coatings, substrate 906 may be lowered through sliding door 905 into electrolyte 902 for plating or etching action on cleaned substrate surfaces. The intimate proximity of enclosure 904 and electrolyte 902 prevents re-oxidation of substrate 906 between the coating removal and initiation of plating or etching action. For plating or etching action by electrolyte 902, a potential difference may be established between substrate 906 and a counter electrode 911 by connecting electrode 911 to the opposite polarity terminal of supply 910.

Figure 10:
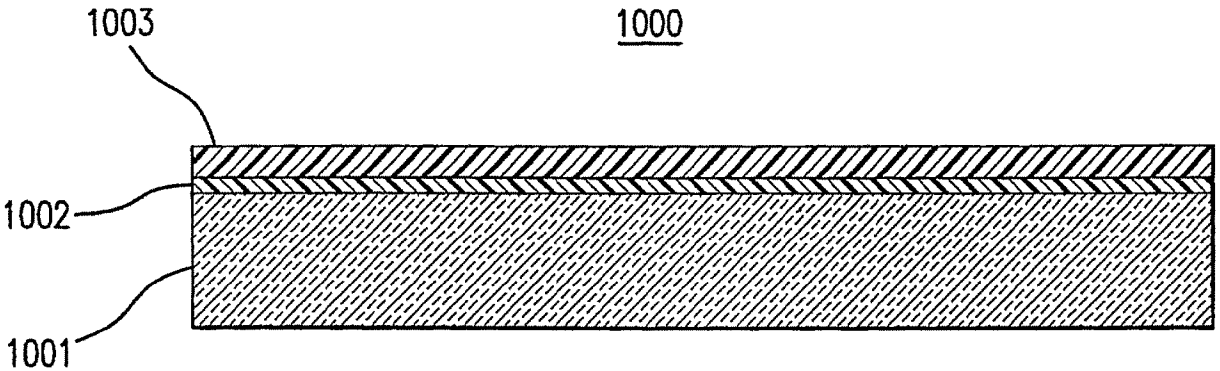
FIG. 10 is a schematic illustration of a composite substrate, which may be plated or etched in accordance with the principles of the present invention. The composite substrate has an outer material layer supported on a base substrate. The outer layer is coated with an inhibiting coating film which is removed prior to plating or etching of the composite substrate.

FIG. 10 shows an exemplary composite substrate 1000, which may be plated or etched using the inventive systems and methods. Substrate 1000 may, for example, include a silicon, or glass base 1001 on whose surface a film 1002 is deposited. An inhibiting film 1003 may reside on top of film 1002. Removal of film 1003 (and/or film 1002) may be necessary for successful plating or etching of composite substrate 1000. Such removal may be effected using the systems and methods described herein.

The present invention also provides additional techniques and arrangements for in situ removal of inhibiting or interfering surface films to prepare substrates for plating and/or etching. These additional techniques include induction heating, microwave heating and mechanical stamping processes. The additional techniques may be individually used to prepare substrates for plating and/or etching. Alternatively, the techniques may be used in any suitable combination (e.g., abrading and stamping, stamping and microwave heating, etc.) to prepare substrates for plating and/or etching.

Induction heating is a well known method for providing fast, consistent heat to a metallic object. Induction heating is used in many manufacturing applications, including, for example, bonding, annealing, metal working and the like. In common induction heating arrangements, an ac coil (i.e., induction coil) is placed in close proximity to a work piece or substrate. The ac coil radiates a time-varying electromagnetic field, which induces eddy currents in a surface layer ("skin depth") of the metal or metallic work piece/substrate. These eddy currents dissipate energy in the skin depth causing the temperature of the work piece/substrate to rise. The thickness of the "skin depth" of the metal or metallic work piece/substrate depends on the frequency of the ac current driving the induction coil and on the intrinsic electric conductivity of the metal or metallic work piece/substrate. The overall work piece/substrate heating is also a function of the thermal conductivity, geometry and the immediate environment of the work piece/substrate.

In the present invention related to metal plating and etching, substrates are subjected to induction heating to remove inhibiting surface films or regrowth. The substrates may be inductively heated when they are either (1) submerged in a plating/etching solution bath or (2) contained within an inert atmosphere in a preparation chamber in close proximity to the plating/etching bath.

Figure 11:
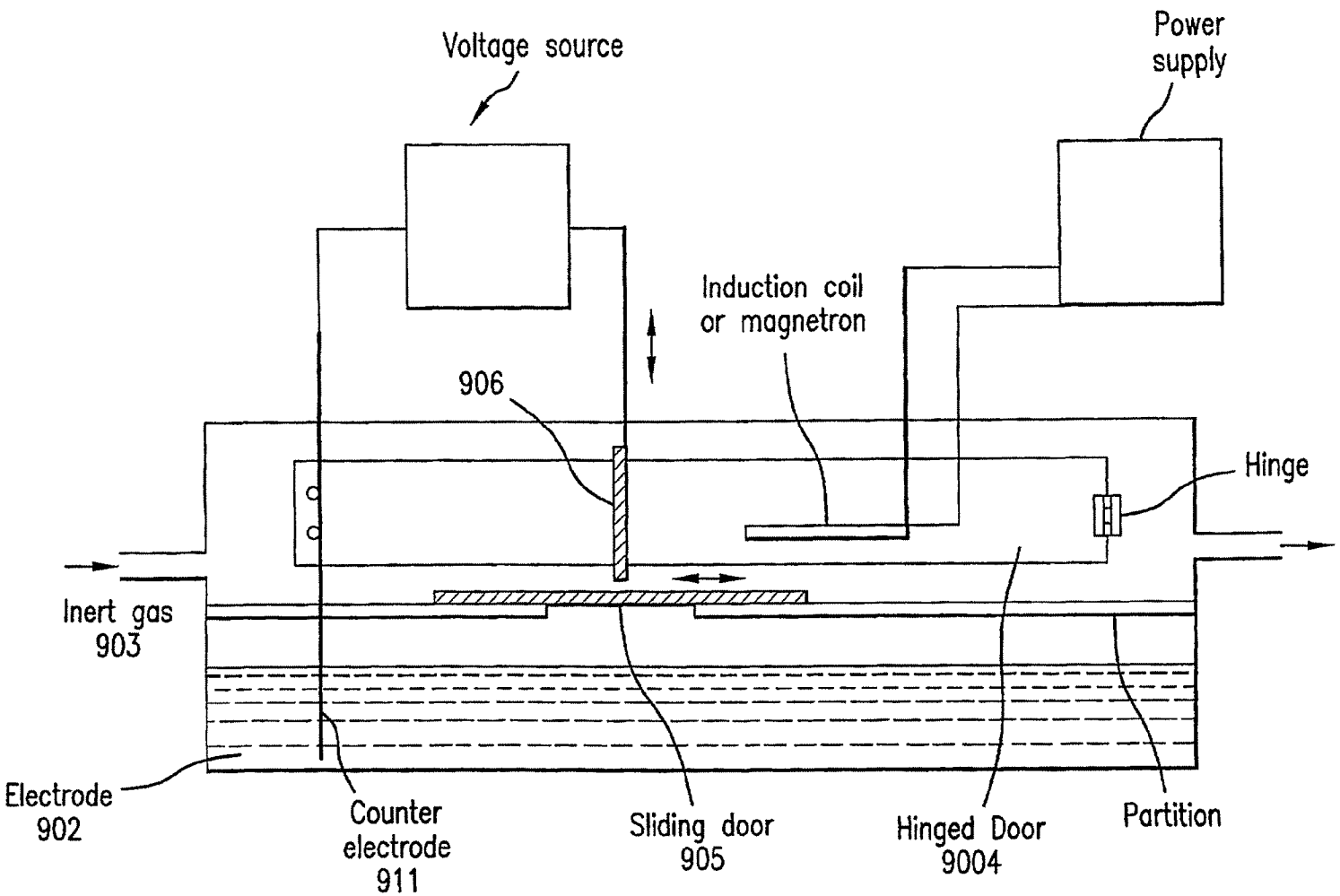
FIG. 11 is a schematic illustration of an exemplary plating/etching cell arrangement, which is configured for removal of an interfering insulating surface film by induction heating or microwave irradiation just prior to metal plating or etching of a subject substrate, in accordance with the principles of the present invention.

FIG. 11 shows such a preparation chamber, which may be used to prepare substrates for plating/etching. The substrates may be inductively heated in an inert atmosphere to remove inhibiting oxide or other films. Immediately after the inductive heating step, the substrates can be subjected to etching or plating action. FIG. 11 shows an arrangement in which the preparation chamber is separated from the plating/etching tank by a partition wall. Substrates that are inductively heated in the preparation chamber can be rapidly transferred to the plating/etching tank through a sliding door in the partition wall.

The substrates may be inductively heated using either continuous wave (cw) or pulse heating in the inert atmosphere to remove inhibiting oxide or other films. The frequency of the radiated electromagnetic field produced by the induction coil at least in part determines the depth of heating of the substrate. The higher the frequency of the radiated electromagnetic field the greater is the localized surface-like nature of the heating of the substrate, due to the well known electromagnetic skin depth effects. In most instances, there is no need to heat the bulk of the substrate for simply removing the inhibiting surface films. For localized surface heating, which is most effective for removal of inhibiting surface films, it may be desirable to use induction frequencies greater than 60 kHz. A practical frequency regime is at least 100 kHz or greater. Subjecting the substrate to GHz microwave radiation, which is typically generated by a magnetron, may be especially effective in removing the inhibiting film by localizing the heating to a thin surface region. A magnetron-microwave system for removing inhibiting films is also shown in FIG. 11.

Induction heating or microwave irradiation heating for removing surface inhibiting films may be most effective in a preparation chamber separate from the plating/etching bath in order to prevent heating of plating/etching solution itself.

In some instances, induction heating also may be exploited to heat substrates that are submerged in a plating/etching solution. Such induction heating is likely to also heat the plating/etching solution. Circulation and/or cooling of the plating/etching solution may overcome any undesirable or excessive heating of the plating/etching solution caused by induction heating.

Figure 12:
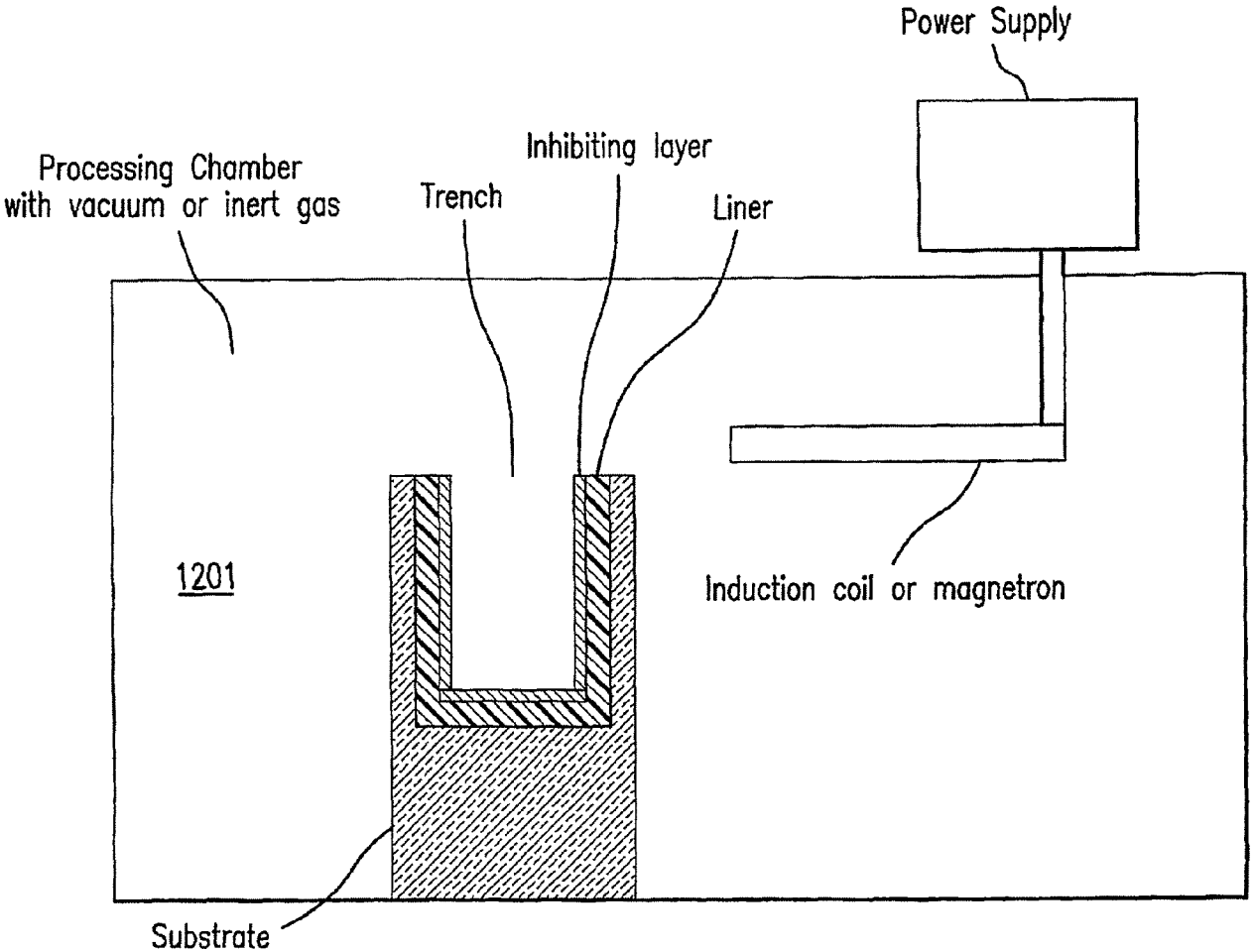
FIG. 12 is a schematic illustration of an exemplary induction heating arrangement, which may be used to remove inhibiting surface films on substrates with trenched surface topography such as silicon substrate wafers, in accordance with the principles of the present invention.

FIG. 12 shows a preparation chamber 1201 in which microwave or induction coil heating is used to remove a thin oxide or inhibiting film from trenches in a substrate prior to plating action. The substrate may, for example, be a semiconductor silicon substrate that has trenches built in its surface as part of common semiconductor device fabrication processes or steps. FIG. 12 shows a substrate topography with only one trench for purposes of clarity in drawing. It will be understood that the substrate may be a silicon wafer substrate, which in typical semiconductor device fabrication processes may have thousands or several thousands of such adjacent trenches in close proximity to each other. In current semiconductor device fabrication processes, it is desirable to be able to plate copper in the trenches for making electrical conductor lines. To plate copper on silicon to make electrical conductor lines, a liner (e.g., a thin film of Ta or TaN) is first deposited in the trenches onto the silicon trench surface itself or on an intermediary thin layer of silicon dioxide.

Figure 13:
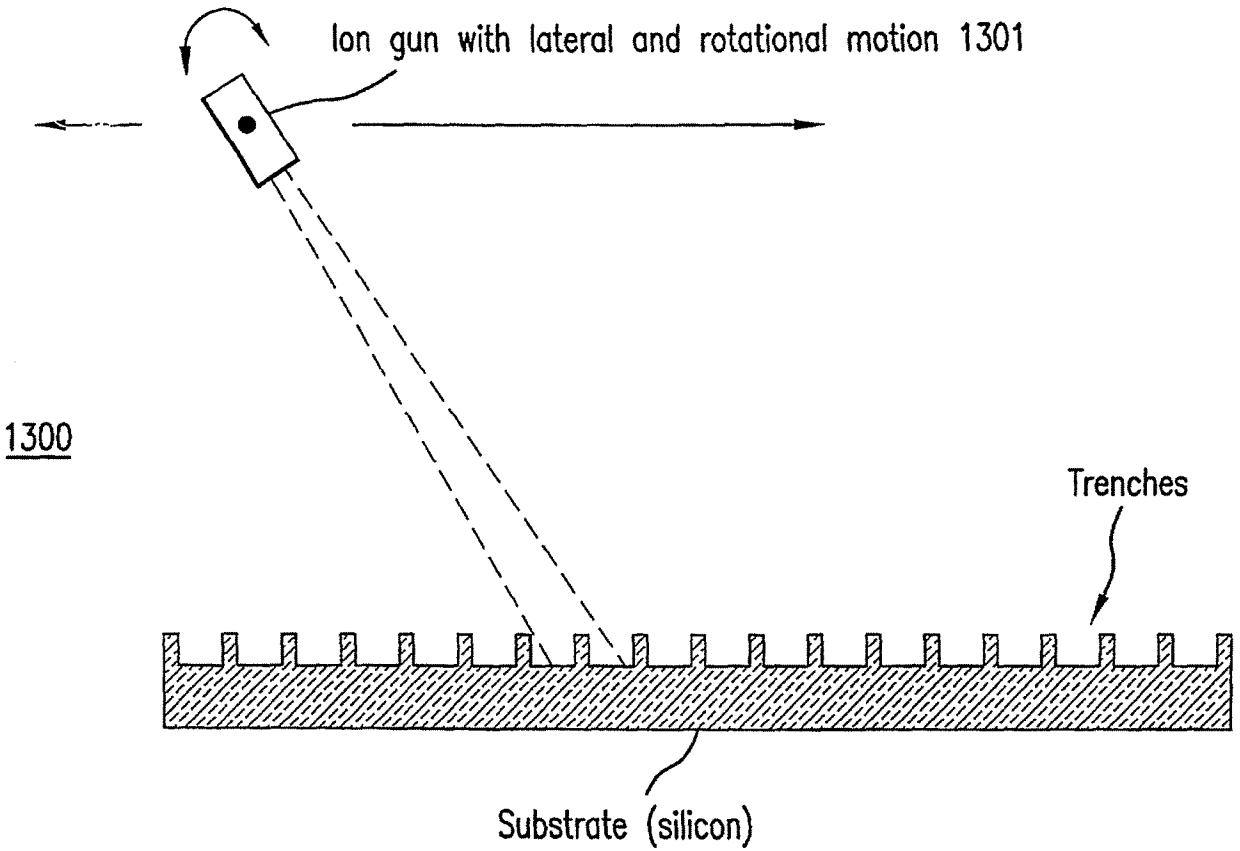
FIG. 13 is a schematic illustration of another arrangement, in which an ion beam is used to remove inhibiting surface films on substrates with trenched surface topography such as silicon substrate wafers, in accordance with the principles of the present invention.

As an alternative or in addition to the induction heating and/or magnetron heating techniques already described, ion beam heating may be used to prepare substrates for plating. The ion beam heating technique may be particularly suited for preparing "trenched" substrate topography for plating/etching. FIG. 13 shows an arrangement 1300 with a movable ion gun (e.g., ion gun 1301 with lateral and rotational motion). The arrangement may be used for an ion beam process to prepare an array of trenches on a wafer surface for subsequent plating action. As shown in FIG. 13, a directed ion beam generated by the ion gun can be made to scan the wafer surface in swivel and/or raster pattern. Typically, the wavelength of ion beam is in the submicron range so that the beam can reach into the trenches in a manner that is not possible by typical wavelength laser light. The energy of the ion beam determines the effective particle wavelength. For example, for a 400 eV argon ion beam, the wavelength is on the order of 1 A. The wavelength or energy of the ion beam can be adjusted by changing the number of electron volts of acceleration voltage applied to the ion beam. The ion beam energy is adjusted so that it is sufficiently energetic to remove the inhibiting layer without affecting the liner as shown in FIG. 13.

Figure 14:
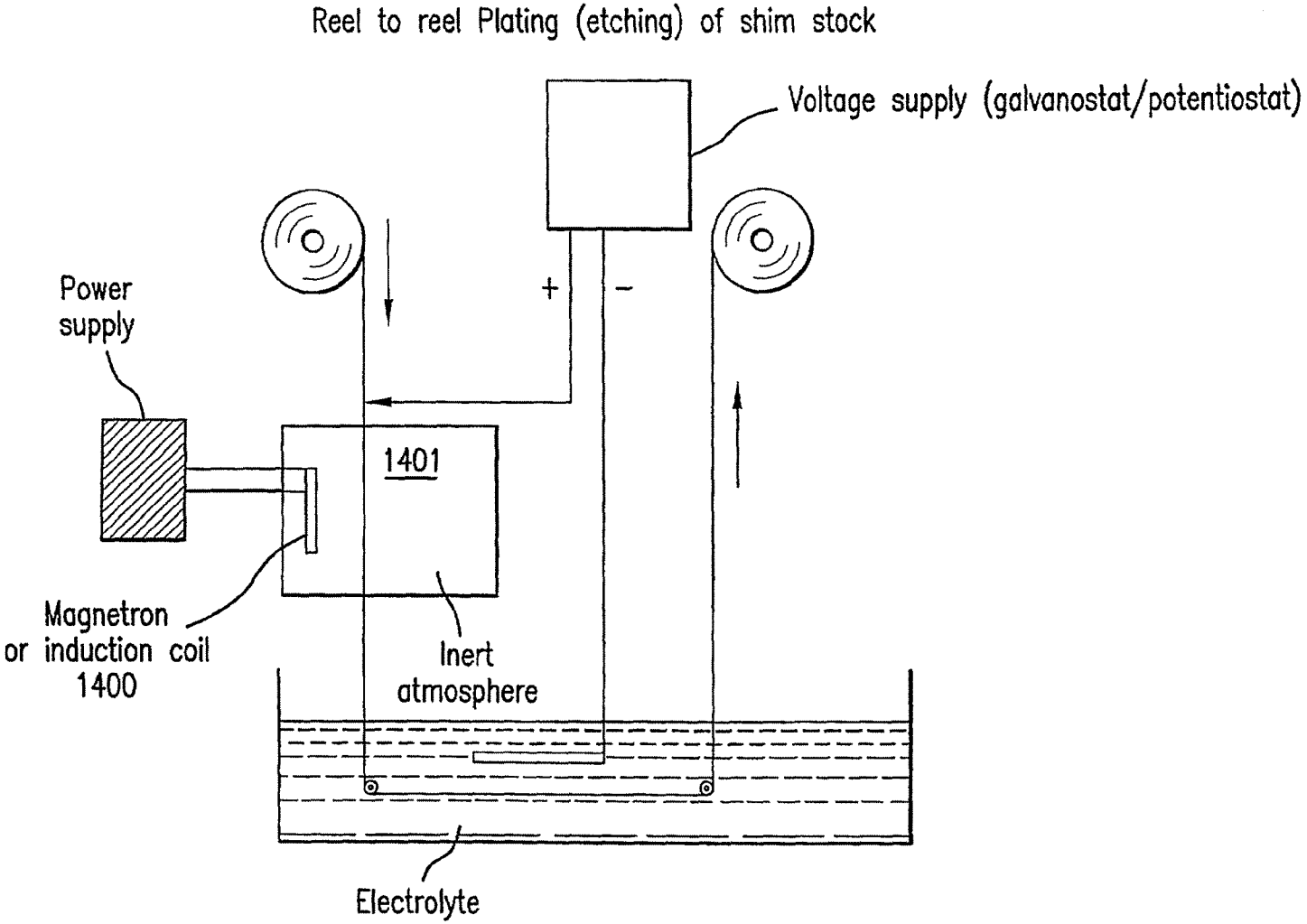
FIG. 14 is a schematic illustration of an exemplary reel-to-reel plating/etching cell arrangement having a substrate preparation chamber in which induction heating or magnetron radiation is used for removal of interfering surface films, in accordance with the principles of the present invention.
Figure 15:
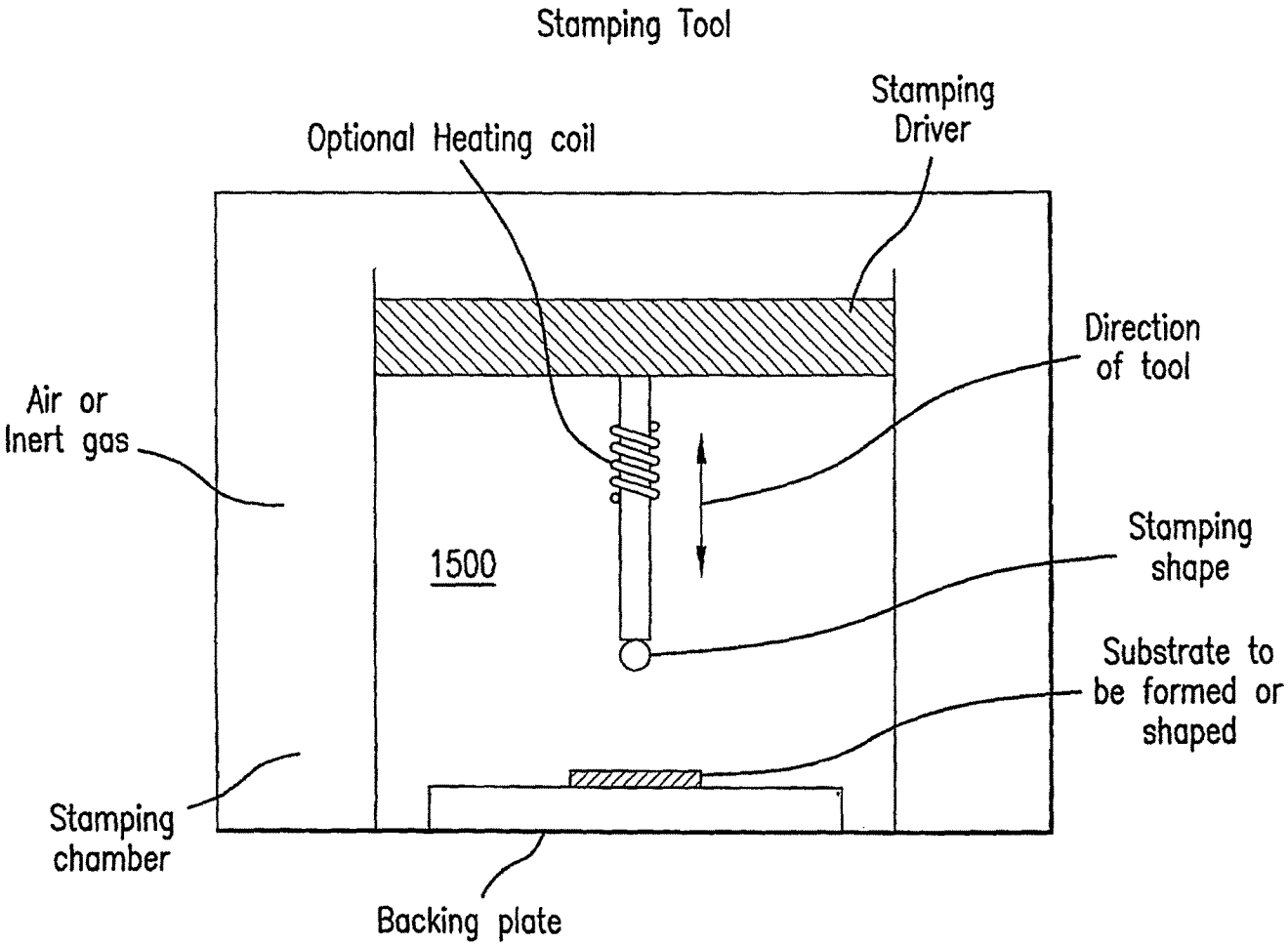
FIG. 15 is a schematic illustration of a stamping press, which is used to prepare shaped substrates in an oxide-layer free condition suitable for plating or etching action, in accordance with the principles of the present invention.

FIG. 14 shows the use of an induction coil (or magnetron) heating arrangement 1400 in a reel-to-reel system for plating/etching continuous substrates (e.g. shim stock). In the configuration shown in FIG. 14, an induction coil or magnetron is provided in a preparation chamber 1401. The raw substrate material from the stock reel passes through the preparation chamber, which may contain an inert gas or a vacuum. The passing substrate material is inductively heated in chamber 1401 using either a cw or pulsed mode radiation. The substrate material then passes directly into the plating/etching bath after which it is rewound on a take-up reel. The system of FIG. 14 is similar to the reel-to-reel systems described, for example, with reference to FIGS. 8*a*-8*d*, except for the manner in which the substrates are prepared for plating/etching. The systems of FIGS. 8*a*-8*d* use direct current heating or the mechanical abrading of the raw substrate as it is unwound from the reel prior to entering the plating/etching bath followed by rewinding on a take-up reel. In contrast, the system of FIG. 14 uses induction heating of the raw substrate material prior to metal plating/etching.

Another mechanical surface film removal technique may be utilized to remove inhibiting coatings, for example, from substrates that are shaped by stamping processes. (See e.g., FIG. 15). In such processes, a stamping tool 1500 is driven by force against the substrate to change the latter's mechanical form into a desired pattern or shape. The stamping processes may be operated either at room temperature or heated temperatures. When sufficient force is used to drive the stamping tool, the stamping processes not only serve their primary function of mechanically shaping the substrate, but also can result in removal of the inhibiting coating (e.g., a thin oxide layer).

According to the present invention, a substrate stamping operation is conducted in conjunction with and in close proximity to the metal/plating operations. The stamping operation is conducted just prior to moving the resultant shaped substrate into a plating or etching bath. The shaped substrates, free of inhibiting coatings after stamping, are moved rapidly to the plating bath in a short time interval to prevent any significant re-oxidation.

The stamping operation can be carried out in air, vacuum, or an inert gas. With suitable selection of the stamping process parameters and conditions, the stamping operation makes it possible to plate onto the re-shaped metal substrates that normally cannot be plated or are difficult to plate due to inhibiting films. New types of substrate materials can be used to substitute or replace current substrate materials for industrial applications. For example, presently copper or copper alloys are used in the connector industry for making connectors. Conventional connectors are made by stamping copper substrates or sheets and then plating them (e.g., with gold). With the present invention, it will be possible to use aluminum or titanium metal for connectors with plating occurring after stamping. The combination of stamping operations with metal/plating operations according to the present invention is particularly suited for use by the connector industry in which stamping operations are usually undertaken prior to plating.

Figure 16:
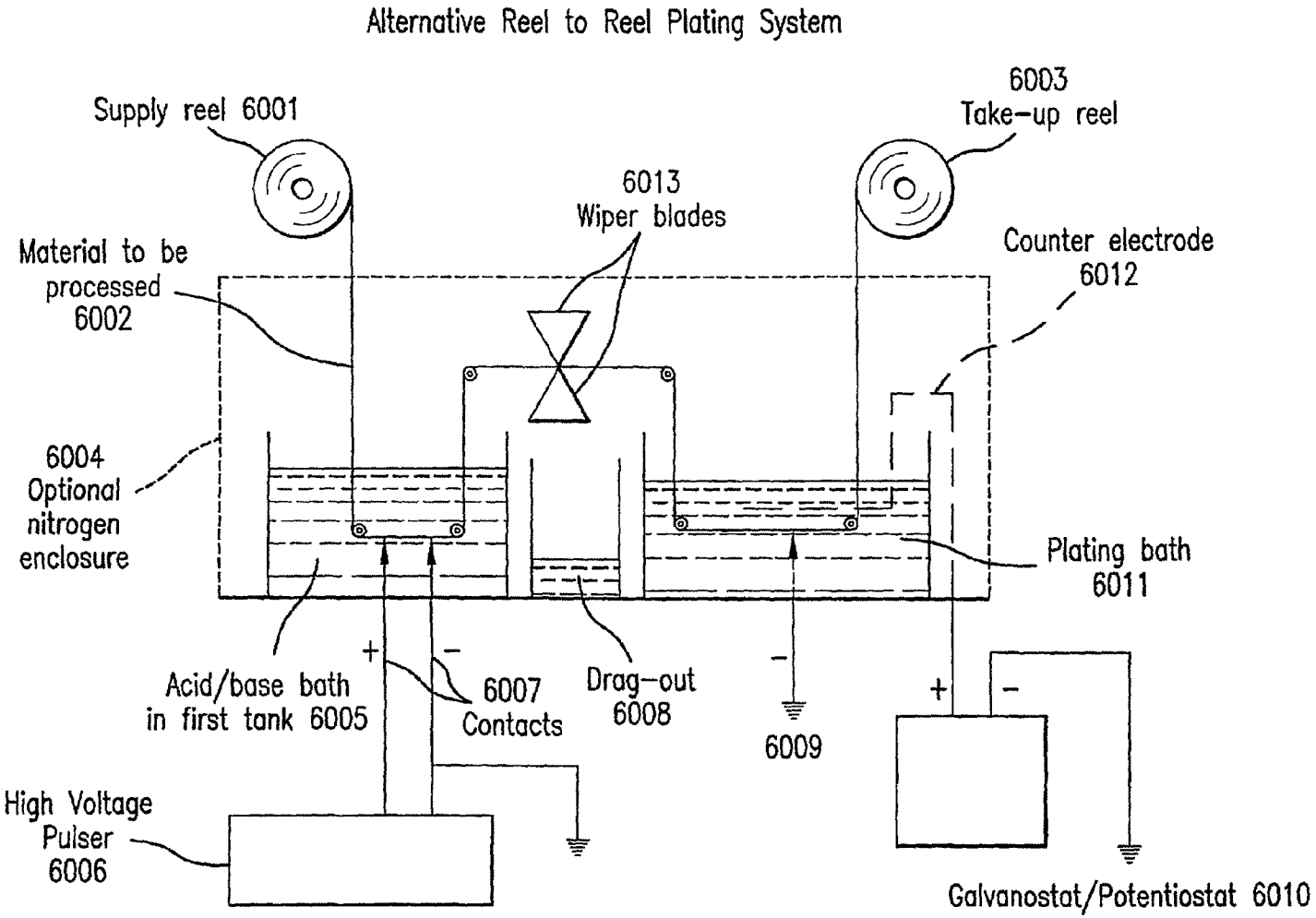
FIGS. 16 and 17 are schematic illustrations of exemplary plating/etching cell arrangements in which separate tanks are provided for removal of interfering insulating surface films on a substrate and for plating the substrate, in accordance with the principles of the present invention.
Figure 17:
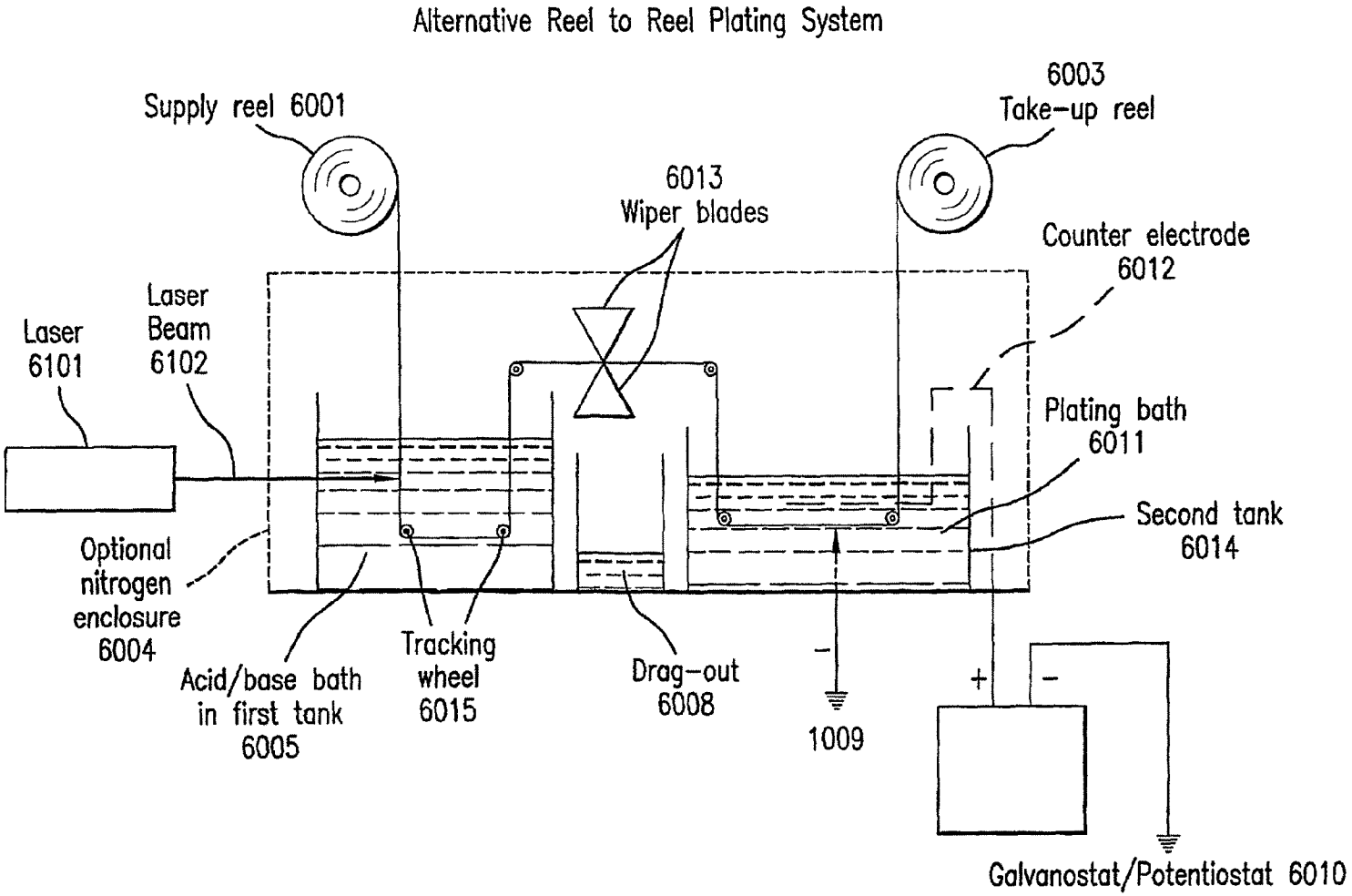
Figure 20:
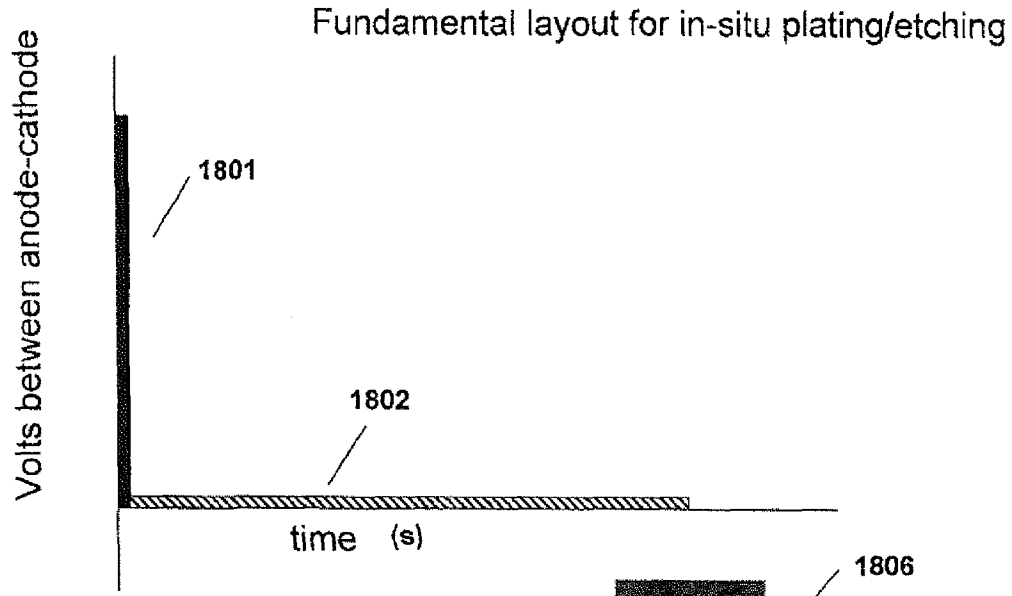
FIGS. 20 and 21 are schematic illustrations of the alternating high voltage and low voltage pulses that can be used in electroplating or etching processes in the cell arrangements of FIGS. 18 and 19, respectively.

FIGS. 16 and 17 show other exemplary plating/etching cell arrangements, in which removal of the inhibiting oxide or film and subsequent plating operations are performed in two separate tanks. The provision of two separate tanks permits flexibility in selecting process conditions for the removal and plating processes independently. FIGS. 16 and 17 shows a reel-to-reel system 6000 having two separate tanks 6005 and 6014 for oxide removal and plating, respectively. Tanks 6005 and 6014 may be enclosed in an optional inert atmosphere enclosure 6004. In system 6000, material 6002 is supplied from reel 6001 and processed material is picked up by reel 6003. Material 6002 passes from supply reel 6001 by way of small tracking wheels 6015 into the bath of the first tank 6005 and then into tank 6014. Tank 6005 may contain a bath (e.g., a acid such as sulfuric acid, or a base such as sodium hydroxide) in which the inhibiting layer on material 6002 is removed by application of a short electrical pulse from a high voltage pulser 6006 to the supply reel material 6002. As seen in FIG. 16, high voltage pulser 6006 has closely spaced electrode contacts 6007 which make contact with material 6002. The duration of the electrical pulse, which is applied across contacts 6007, may be about 10 nanoseconds to about 100 milliseconds. The particular voltages selected for the electrical pulse may depend on the pulse duration. Higher voltages may be required for shorter pulses. Further, a repetition rate of pulser 6006 may be determined by the speed of the reels. In order to obtain a continuous inhibiting film removal, the pulse repetition rate may be about 1-10,000 times per second.

Alternatively or additionally, the inhibiting layer residing on material 6002 may be removed by means of laser heating or photoablation. FIG. 17 shows an arrangement in which laser 6101 emits a laser beam 6102 while material 6002 is immersed in tank 6005 before it is plated in second tank 6014. FIG. 17 shows setup a similar to that shown in FIG. 16 except that pulser 6006 supplying electric pulses to material 6002 in first acid/base tank 6005 is replaced by a pulsed or CW laser 6101 positioned external to tank 6005. Laser 6101 is positioned and operated so that laser beam 6102 is incident on material 6002 in first tank 6005. In operation for oxide or inhibiting film removal, the laser pulses may have a width in the range of 1 ns to 100 ms with a preferred value in the range of about 10 femtoseconds to 10,000 microseconds. The pulse repetition rate may be in the range of about 1-100,000 pulses per second. The laser wavelength may be in the range of about 0.1 to 10 micrometers. It will be understood that in the case where laser 6101 is a CW laser, suitable electromechanical and/or optical scanning mechanisms may be provided to scan the laser beam with respect to the surface of material 6002 undergoing plating or etching.

The acid or base used in tank 6005 is preferably the same acid or base used in plating bath 6011, which is contained in the second tank 6014. The acid or base used in tank 6005 is free of plating metal ions. Cross-contamination or compositional change of plating bath 6011 in second tank 6014 may result if fluids from the first bath adhere to material 6002 upon exiting tank 6005 and are transferred to tank 6014. To avoid such compositional change, material 6002 exiting tank 6005 may be wiped clean using, for example, wiper blades 6013. Wiped liquids may be collected in and drained from drag-out container 6008. Alternate methods of cleaning or drying (e.g. radiation from a heating lamp, a nitrogen gas blower and the like) can also be employed for the same purpose.

Plating of material 6002 takes place in plating bath 6011 in the second tank 6014, either galvanostatically or potentiostatically, using galvanostat/potentiostat (or voltage source) 6010. Material 6002 to be plated may be biased negatively relative to voltage source 6010 using grounded contact 6009. A counter electrode/contact 6012 may be biased positively directly from voltage source 6010. Both contacts 6009 and 6012 have ends positioned in second tank 6014 containing plating bath 6011 in order to contact material 6002. Pulse plating, which is well known to those skilled in the art, also may be used. After exiting second tank 6014, a third tank (not shown) may be used to rinse the plated material before it is re-wound on take-up reel 6003.

It is noted that FIG. 16 shows two power supplies—one power supply to apply pulses 6006 to material 6002 received from supply reel 6001 while in the first tank 6005, and a second power supply to supply required plating voltages/currents while material 6002 is in second tank 1014. The procedure in first tank 6005 removes the inhibiting film making material 6002 sufficiently clean to make plating possible in the second tank 6014.

Additional examples of cell arrangements and plating/etching processes for substrates having inhibiting surface films are described herein with reference to FIGS. 18-23.

Figure 18:
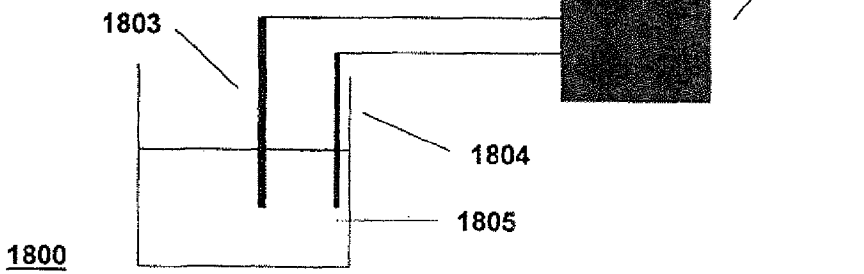
FIG. 18 is a schematic illustration of another exemplary plating/etching cell arrangement for obtaining electrolytic plating or etching of individual substrates having inhibiting surface films, in accordance with the principles of the present invention. The plating/etching cell is configured so that a high voltage pulse (or a series of pulses) is applied to the substrate to remove the interfering inhibiting surface films and then a low voltage signal, which can be a cw or a modulated cw signal, is applied to activate the desired plating and/or etching processes.
Figure 19:
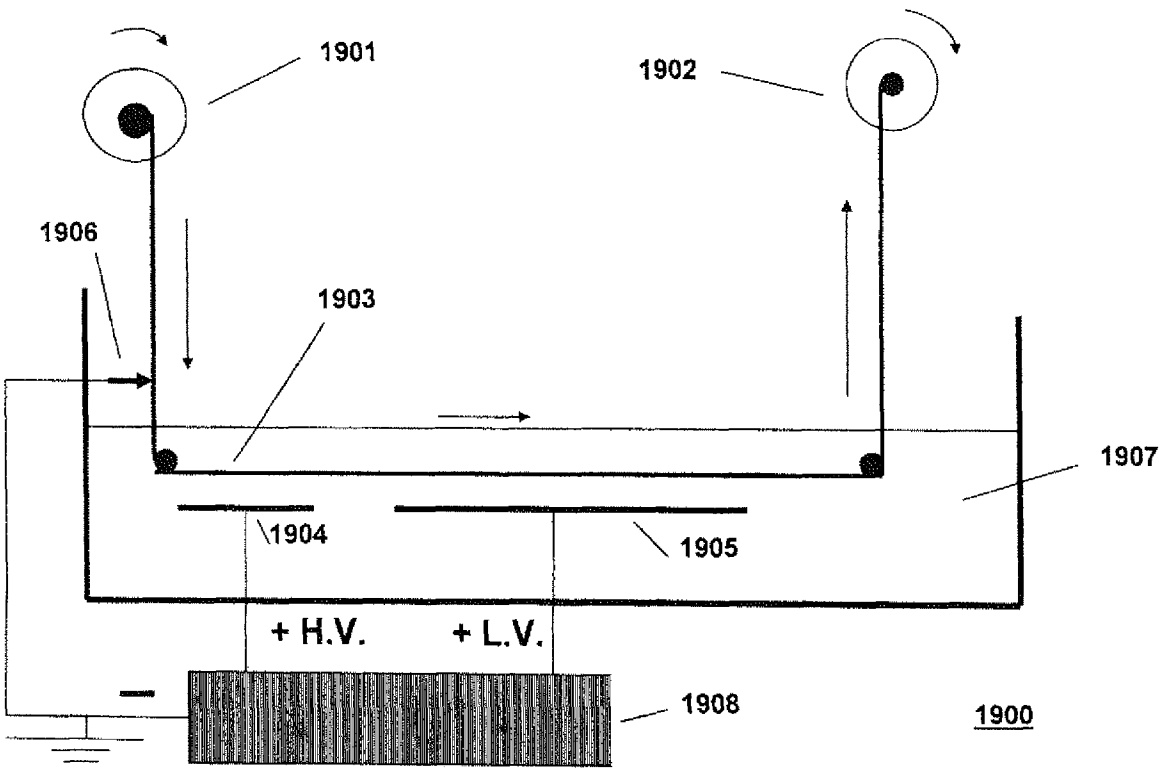
FIG. 19 is a schematic illustration of yet another exemplary plating/etching cell arrangement for obtaining electrolytic plating or etching of long wire or flat sheet stock substrates having inhibiting surface films, in accordance with the principles of the present invention. The plating/etching cell arrangement includes a reel-to-reel material handling system. Like the plating/etching cell arrangement of FIG. 18, the plating/etching cell is configured so that a high voltage pulse can be applied to the substrate to remove the interfering or inhibiting surface films, and then a low voltage signal can be applied to activate the desired plating and/or etching processes.
Figure 21:
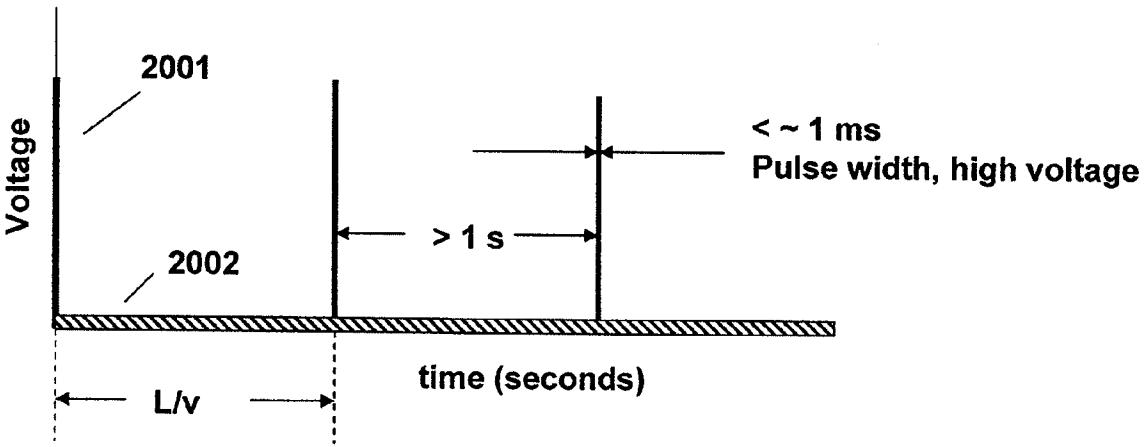

FIGS. 18 and 19 show plating/etching cell arrangements 1800 and 1900 for individual substrates and long lengths of wire or sheet flat stock substrates, respectively. With reference to FIG. 18, in cell arrangement 1800, individual substrate 1803 and counter electrode 1804 are mounted facing one another and immersed in electrolyte 1805. A voltage source 1806 is connected across counter electrode 1804 and individual substrate 1803, which serves as a working electrode. For plating or deposition processes, the negative pole of voltage source 1806 may be connected to substrate/working electrode 1803. Conversely, for etching processes, depending on the electrolyte used, either the positive pole or the negative pole of voltage source 1806 may be connected to the substrate/working electrode 1803. Voltage source 1806 is configured to generate both high and low voltage pulses. In operation, a high voltage pulse (or a series of pulses) is followed by a low cw or modulated voltage signal for a period of time which is determined by the desired thickness of deposition or depth of etching.

The high voltage and low voltage pulses are applied between substrate/working electrode 1803 and counter electrode 1804. (See FIG. 18). First, a high voltage pulse 1801, which is on the order of 20-2000V, is applied so that a current of at least about 120-200 A/cm$^2$ flows between substrate/working electrode 1803 and counter electrode 1804. High voltage pulse 1801 may have a full width at half maximum on the order of 10 ns to 1 s. These voltage and current parameters for high voltage pulse 1801 correspond to energies of at least 5-14 Joules/cm$^2$ delivered to substrate/working electrode 1803. Application of high voltage pulse 1801 results in removal of the inhibiting oxide or film on substrate/working electrode 1803. Next, a low voltage pulse 1802 on the order of 0.01-5 volts is applied between substrate/working electrode 1803 and counter electrode 1804. Low voltage pulse 1802 may have a pulse width of about 1 second, and may be modulated using suitable microprocessor or computer coupled to voltage source 1806. The application of low voltage pulse 1802 is designed to activate the desired electrolytic plating or etching processes on the surface of substrate/working electrode 1803.

With reference to FIG. 19, cell arrangement 1900 is configured with a reel-to-reel material handling system for long length wire or sheet flat stock substrate 1903. The reel-to-reel material handling system includes a supply reel 1901 and a take-up reel 1902 on which unprocessed and processed substrates 1903 are respectively wound. Substrate 1903, which functions as a working electrode, passes through electrolyte 1907 facing split counter electrodes 1904 and 1905. Voltage source 1908 is connected across substrate/working electrode 1903 and counter electrodes 1904 and 1905. Voltage source 1908, which like voltage source 1806 is capable of generating both high and low voltage pulses, may have a low voltage terminal, a high voltage terminal and a common terminal. The high voltage and low voltage terminals of voltage source 1908 are connected to counter electrodes 1904 and 1905, respectively, while the common terminal is connected to substrate/working electrode 1903.

In operation, voltage source 1908 generates high voltage pulses 2001 and low voltage pulses 2002 for reel-to-reel plating of substrate 1903. (See FIG. 21). High voltage pulses 2001 are applied across counter electrode 1904 and substrate/working electrode 1903. A high voltage pulse 2001 (or a series of pulses), like high voltage pulse 1801, is designed to result in removal of the inhibiting oxide or film on the portion of substrate/working electrode 1903 facing electrode 1904. Each high voltage pulse 2001 may only be on for the order of at most a few milliseconds. Low voltage pulses 2002, which may be cw or modulated cw signals, are applied across counter electrode 1905 and substrate/working electrode 1903 to portions of substrate 1903 that have traveled from facing electrode 1904 to facing electrode 1905. Low voltage pulses 2002 may be continuous wave or modulated low voltage pulses that are designed to activate the desired plating or etching processes. With this arrangement, high voltage pulses 2001 may be applied with a repetition rate of "L/v" seconds, where L is the length of counter electrode 1904, and v is the linear travel speed at which substrate/working electrode 1903 is pulled through electrolyte 1907 across electrode 1904 and electrode 1905. The linear travel speed v may be adjusted so that low voltage pulses 2002 are applied across electrode 1905 to a portion of substrate/working electrode 1903 within less than a second after the application of high voltage pulse 2001 across electrode 1904 to the same portion of substrate/working electrode 1903. The durations of low voltage pulses 2002 may be selected upon consideration of length of counter electrode 1905 and the rate of deposition or etching, which rate in turn depends on the type of electrolyte 1907 used for plating or etching and the type of substrate/working electrode 1903. In practice, the durations of low voltage pulses 2002 may be on the order of at least several seconds, which is comparable to the time it takes for substrate/working electrode 1903 to travel across electrode 1905. Additionally, low voltage pulses 2002 may remain on concurrently with high voltage pulses 2001, or alternatively may be interrupted for the durations of high voltage pulses 2001 that are of the order of at most a few ms.

Figure 22:
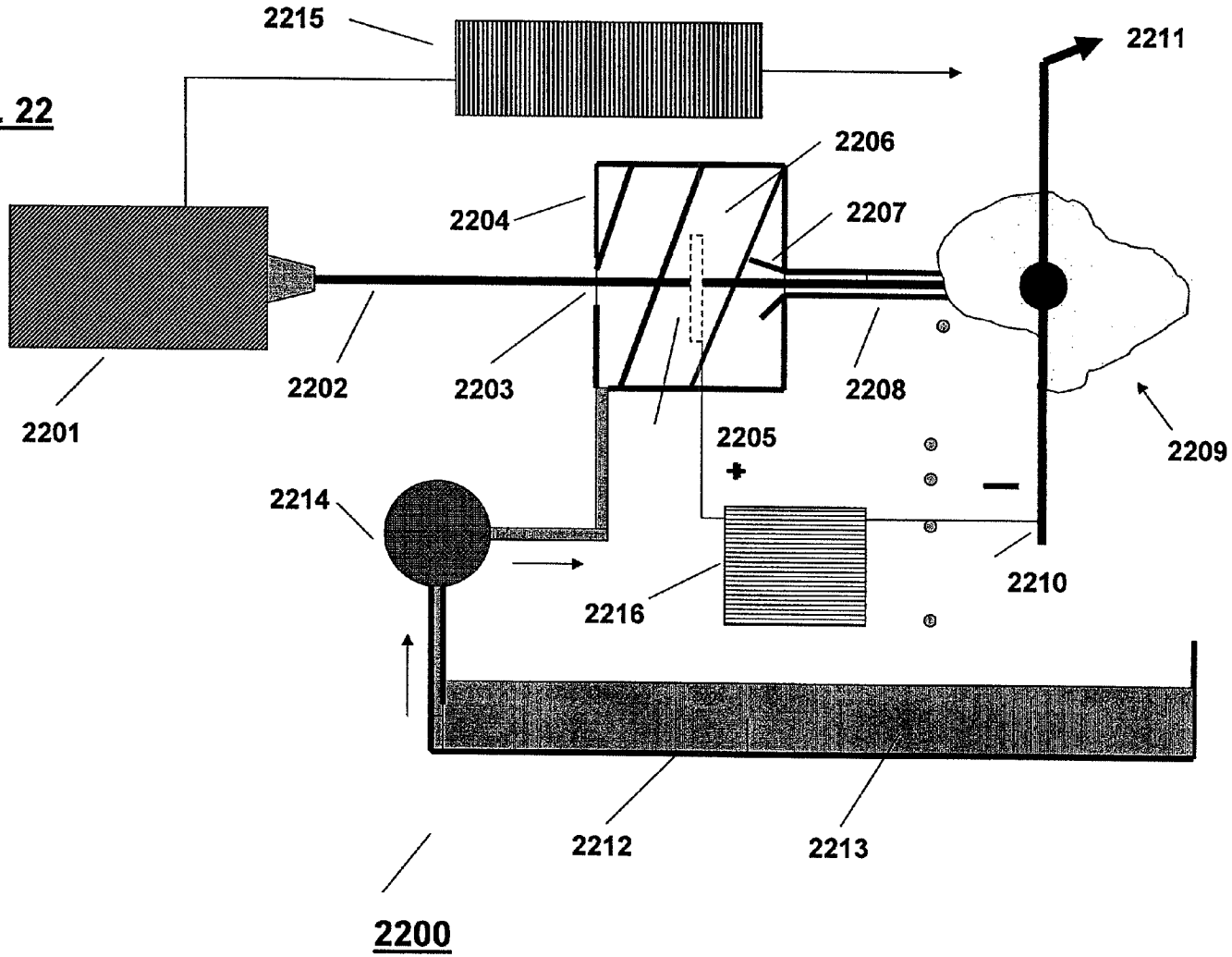
FIG. 22 is a schematic illustration of still another exemplary plating/etching cell arrangement for obtaining electrolytic plating or etching of substrates having inhibiting surface films, in accordance with the principles of the present invention. The plating/etching cell arrangement employs an electrolyte jet to co-linearly guide a high intensity laser beam for removal of the inhibiting surface films.

FIG. 22 shows another etching/plating cell arrangement 2200 for etching/plating of substrates with inhibiting surface films. Cell arrangement 2200 is advantageously configured for processing a three-dimensional substrate 2209. Cell arrangement 2200 uses an electrolyte jet stream 2208 to etch or plate the surfaces of substrate 2209, which is held by an electrically conducting robotic arm 2210. A voltage supply 2216 is connected across substrate 2209 and electrode 2205 disposed in an electrolyte-holding pressure cell 2204. Electrode 2205 serves as an anode and a cathode for plating and etching processes, respectively. Electrolyte jet stream 2208 is generated from electrolyte-holding pressure cell 2204 and directed by nozzle 2207 on to substrate 2209. Further, nozzle 2207 may have a diameter in the range of from 100-10,000 microns for typical applications. Electrolyte 2213 is pressurized into jet stream 2208 through nozzle 2207 by pump 2214, which forces electrolyte 2213 from reservoir 2212 into pressure cell 2204. Electrolyte 2213 flows into pressure cell 2204 through an opening in electrode 2205, which for electroplating processes is connected to the positive polarity of voltage supply 2216. Different portions of the surfaces of substrate 2209 are presented to jet stream 2208 for processing by movement of robotic arm 2210 under the control of robotic control system 2211 and computer 2215.

Cell arrangement 2200 further includes provisions for modifying the free-standing jet plating or etching processes with an electromagnetic energy beam (e.g., an intense laser beam) directed collinearly along jet stream 2208. For this purpose, cell arrangement 2200 includes a pulsed laser 2210 which generates a laser beam 2202. Pulsed laser 2210 is aligned so that laser beam 2202 passes through window 2203 into pressure cell 2204 and then through electrode 2205 along nozzle 2207. On exiting pressure cell 2204, laser beam 2202 is guided by jet stream 2208 which acts as a wave guide or light pipe causing laser beam pulse 2202 and jet stream 2208 to travel collinearly. This wave guide or light pipe arrangement permits laser beam pulse 2202 and jet stream 2208 to be incident collinearly on surface portions of substrate 2209 presented for processing. Modification of electroplating and etching processes with an intense laser beam have been described, for example, in U.S. Pat. No. 4,497,692.

In cell arrangement 2200, a pulsed laser 2201 produces a set of one or more pulses 2202 of laser light for a total time on the order of 1 ps to 10 ms. The set of pulses 2202 is preferably triggered immediately after a new portion of the surfaces of substrate 2209 is presented to jet stream 2208 for processing by movement of robotic arm 2210. The pulsing of laser 2201 may be co-ordinated with the movement of robotic arm 2210 by computer 2215 which is interfaced with the robotic arm control system 2211.

In operation, laser pulses 2202 incident on substrate 2209 may be configured to have a power density on the order of $10^5$ to $10^{10}$ W/cm$^2$ in order to remove the inhibiting films from the surfaces of substrate 2209. Each laser pulse 2202 may have a pulse width or duration on the order of about 10 ps to 10 ms, and have a fluence of 1-5,000 mJ/pulse. These parameters may be selected on consideration of the cross sectional area of jet stream 2208 as well as the thermal properties of sample 2209 and the coatings thereon.

While laser 2202 is operated in a pulsed mode, jet stream 2208 may be operated in a continuous mode (cw) to activate the desired plating (or etching) processes on the surface of sample 2209. The desired plating or etching can occur after the inhibiting surface films have been removed by application of the high intensity laser pulses 2202. Robotic arm 2210 can move substrate 2209 so that any surface portion of 2209 can be plated (or etched) as determined by computer 2215, which synchronously controls robotic control system 2211 and the pulsing of laser 2201. In some implementations of the invention, laser 2202 may be programmed so that after emitting a high intensity pulse 2202 that removes the inhibiting surface films, the laser emission drops to a much lower power level to induce laser-enhanced jet plating or etching as is well known in the literature.

Figure 23:
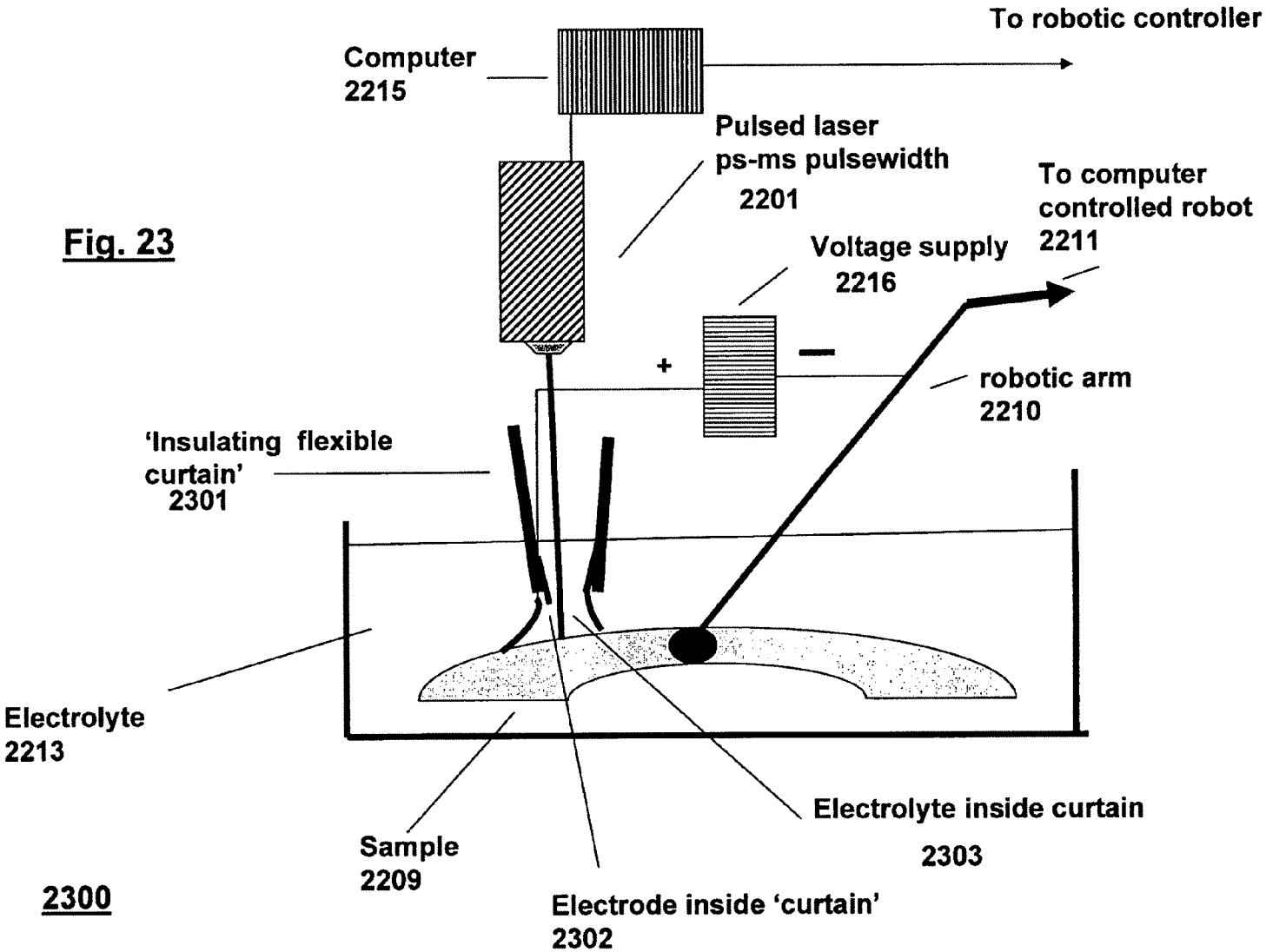
FIG. 23 is a schematic illustration of a further exemplary plating/etching cell arrangement for obtaining electrolytic plating or etching of substrates having inhibiting surface films, in accordance with the principles of the present invention. The plating/etching cell arrangement uses a high intensity laser beam for removal of the inhibiting surface films for substrate surface portions under a defined volume of electrolyte.

FIG. 23 shows another cell arrangement 2300 for modification of electroplating and etching processes with an intense laser beam. Cell arrangement 2300, like cell arrangement 2200, includes pulsed laser 2201, computer 2215, voltage supply 2216, and a computer controlled robot 2211 having an electrically conducting robotic arm 2210 for mounting substrate 2209 in electrolyte 2213. However, electrolyte-holding cell 2206 and nozzle 2207 of cell arrangement 2200 shown in FIG. 22 are replaced in cell arrangement 2300 by an insulating flexible curtain 2301, which defines a volume 2303 of electrolyte 2213. Flexible curtain 2301 preferably has a conical shape. Flexible curtain 2301 includes an inside electrode insert or extension 2302. Electrode 2302, which may be made of small strips of electrically conducting material, is disposed in curtain 2301 in close proximity to substrate 2209. Voltage supply 2216 is connected across electrode 2302 and substrate 2209 with a suitable polarity orientation for either electrolytic plating or etching as desired.

In operation, different surface portions of substrate 2209 are moved under electrolyte volume 2303 by movement of robotic arm 2210 under the control of computer 2215. Like in the operation of cell arrangement 2200, pulsed laser 2201 generates a high intensity laser pulse (or a series of pulses) to remove inhibiting surface films from substrate 2209. The high intensity laser pulse, which may have a duration of a few picoseconds to milliseconds, is directed inside the volume of curtain 2301 on to substrate 2209 to remove inhibiting surface films from surface portions of substrate 2209 under electrolyte volume 2330. As described with reference to FIG. 22, the desired plating/etching of substrate 2209 can occur after the inhibiting surface films have been removed by application of the high intensity laser pulse. Robotic arm 2210 moves substrate 2209 so that any surface portion of substrate 2209 can be plated (or etched) as determined by computer 2215, which synchronously controls robotic control system 2211 and the pulsing of laser 2201.

The movement of substrate 2209 caused by robotic arm 2210 results in curtain 2301 being slid along the surface of substrate 2209. Curtain 2301 can have small holes to allow electrolyte 2213 to recirculate through volume 2303. Alternatively, an auxiliary pump (not shown) can be used to maintain a desired level of electrolyte 2213 inside volume 2303 that is defined by conically shaped flexible curtain 2301.

The foregoing merely illustrates the principles of the invention. Various modifications and alterations to the described embodiments will be apparent to those skilled in the art in view of the teachings herein. It will be appreciated that those skilled in the art will be able to devise numerous modifications which, although not explicitly described herein, embody the principles of the invention and are thus within the spirit and scope of the invention. For example, it will be readily understood by those skilled in the art that the removal/plating processes, which utilize two tanks with their respective baths, can also be used for individual pieces of material without the use of the reel-to-reel material handling system described with reference to FIGS. 16 and 17. In such case, a means of dipping the samples serially into the two tanks may be used instead of the reel-to-reel system.

Further, for example, a suitable contact patterning mask may be directly disposed on the substrate surface to define surface portions for plating or etching. The contact mask may be fabricated using any convenient materials (e.g., negative or positive photoresist layers). While photoresists are one of the most common types of contact masks, other insulating materials (e.g., various tapes, varnishes, paints and lacquers) also can be used. The in situ surface coating removal techniques described herein can be used to prepare the defined surface portions for plating or etching, for example, by removing surface coating layers in the contact mask openings by application of high voltage or discharge pulses. Immediately thereafter, a second voltage pulse can be applied to provide plating or etching action in the contact mask openings in which inhibiting surface coating layers have been removed by the discharge pulse, but without affecting the contact mask pattern. The second voltage pulse used for plating/etching, which may continuous or in the form of repetitive pulse, may have an amplitude on the order of about +/−1-3V. For galvanostatic plating/etching, the second voltage pulse amplitude may be considerably higher depending, for example, on sample size. After the plating/etching step, the substrate is removed for the electrolyte solution, and the masking material stripped.

The foregoing technique of directly masking the substrate for in situ patterned plating/etching advantageously avoids the conventional substrate patterning process steps that require oxide removal over the entire substrate surface prior to masking. The technique enables patterning to take place before the substrate is stripped of its oxide layers. The technique is particularly beneficial in applications involving substrate materials that are highly oxidizable (e.g. Al). For such substrate materials having rapid oxide growth, the substrates are conventionally patterned in an inert atmosphere. This process complexity or burden can be avoided by the foregoing technique of directly masking the substrate for in situ patterned plating/etching.

Figure 24:
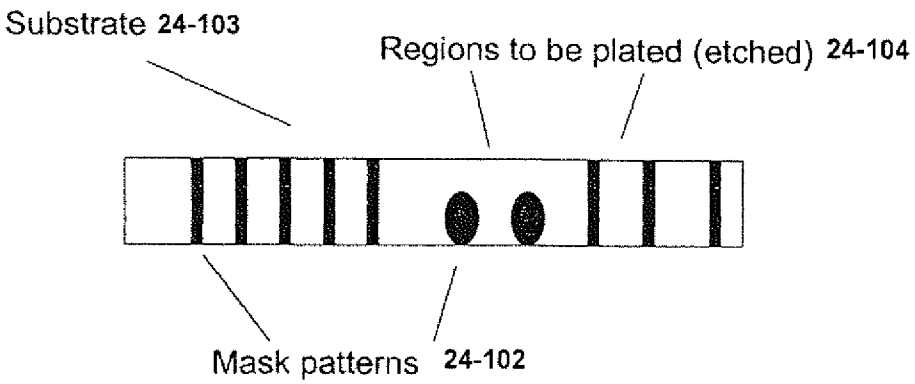
FIG. 24 is a schematic illustration of a sample which a contact patterning mask disposed thereon. The contact mask may be a positive or negative photo resist photo resist layer which patterned using photolithography. Plating and/or etching of the substrate occurs in the pattern openings from which inhibiting surface coatings are removed by the in-situ removal techniques of the present invention.
Figure 25:
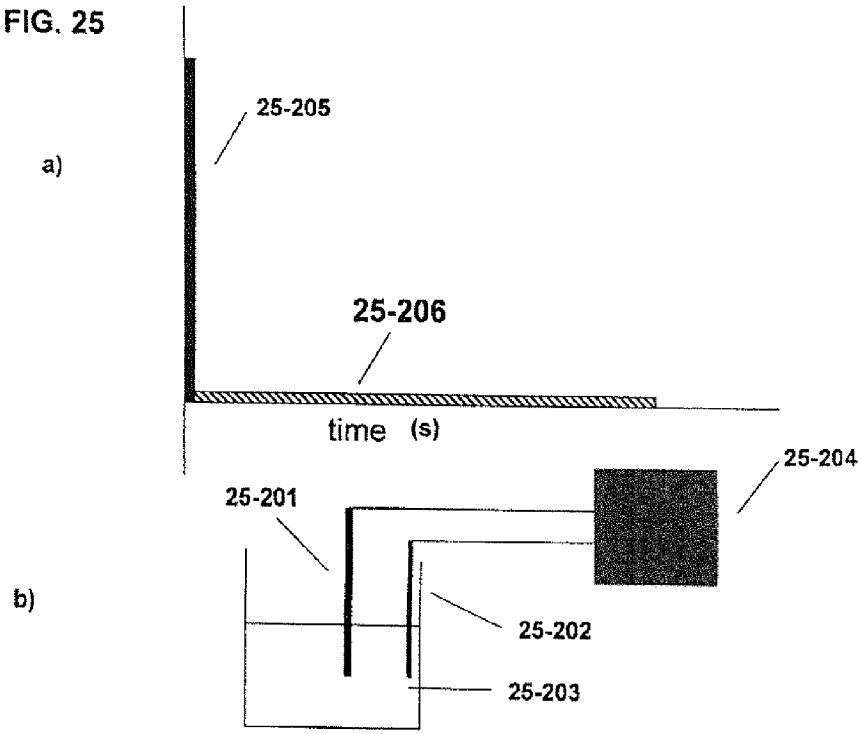
FIG. 25*a* is a schematic illustration of the voltage pulse applied between the counter electrode and the substrate of FIG. 24 while the latter is immersed in an electrolyte cell (FIG. 25*b*) in order to remove inhibiting surface coatings from the substrate surface in the pattern opening regions, in accordance with the principles of the present invention.

In laboratory demonstrations, electroplated patterns of copper on stainless steel 316 substrate have been obtained by first pattern masking the substrate, then applying a voltage pulse to remove surface oxides in the mask openings followed by plating. FIG. 24 shows an exemplary substrate 24-103 used in the laboratory demonstrations. An electrically insulating patterning mask 24-104 is disposed on substrate 24-103 so that regions 24-102 are electrically insulating and therefore are not be subject to surface oxide removal and plating/etching. The exposed mask opening regions 24-104 are subject to surface oxide removal and plating/etching. FIG. 25*b* shows a masked substrate 25-201 (24-103) disposed in an electrolyte 25-203 facing immersed counter electrode 25-202. A power supply 25-204 is configured to apply potential pulses across electrodes 25-202 and 25-203 immersed in the electrolyte. FIG. 25*a* shows an exemplary high voltage pulse 25-205, which is applied to remove surface oxide layers from regions 24-104. Exemplary high voltage pulse 25-205 may, for example, be on the order of 20 V or greater, and have a pulse width of about 1 ms. After the surface oxide removal pulse 25-205, power supply 25-204 may be used to apply lower voltage pulses (e.g., 25-206) for plating or etching action on the "prepared" oxide-free surface regions 24-104.

Figure 26:
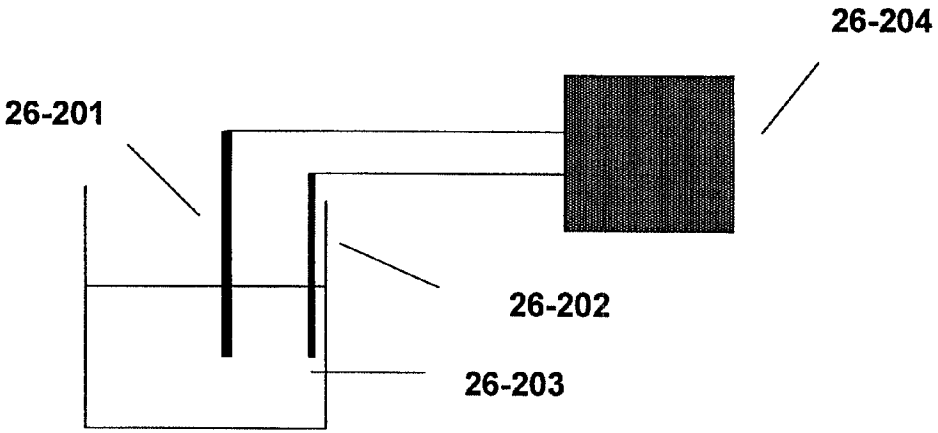
FIG. 26 is a schematic illustration of the electrolyte cell of FIG. 25*b* now used to apply a small voltage for the purpose of plating or etching the substrate surface in the pattern opening regions from which inhibiting oxide layers have been removed by application of the voltage pulse of FIG. 25*a*.

FIG. 26 shows another view of the electrolytic cell and electrode arrangement of FIG. 25*b* used of plating. For plating action, the negative polarity of supply 26-204 is connected to substrate 26-201 (24-103). A small voltage on the order of about 2.0 V is applied between substrate 26-201 and counter electrodes 26-202 for plating etching of oxide-free regions 24-104. After completion of the plating process, the mask material may be conventionally removed (e.g., by stripping dissolving, ashing, etc.) leaving a pattern of plated material in regions 24-104 on substrate 24-201. It will be understood that the same masking technique can be used for patterned etching in regions 24-104 on substrate 24-201.

The invention claimed is:

1. A system for metal-plating and etching a substrate by action of a chemical solution in a tank containing the chemical solution, the substrate covered by an interfering surface metal oxide layer, the system comprising:

a substrate-holding fixture disposed relative to the tank so that the portions of the substrate are submerged in the contained chemical solution;

a laser pulse source adapted to emit a plurality of laser pulses, each having a duration between 1 picosecond and 10 milliseconds and spaced apart by at least approximately 1 millisecond, and adapted to remove the interfering surface metal oxide layer and expose uncoated substrate surfaces to the action of the contained chemical solution, whereby metal-plating and etching can occur directly on the substrate without interference by the interfering surface metal oxide layer, wherein the substrate-holding fixture is further configured as an electrode and a counter-electrode is disposed in the tank forming an electrolytic cell, whereby the chemical solution contained in the tank can act to electroplate or electroetch exposed clean substrate surfaces, and wherein the electrolytic cell and the laser pulse source are configured for one of sequential operation and concurrent operation, and wherein the substrate-holding fixture is further configured to move the substrate with respect to the laser pulse source, thereby exposing a pattern of uncoated substrate surfaces on the substrate.

2. A system for metal-plating and etching a substrate by action of a chemical solution in a tank containing the chemical solution, the substrate covered by an interfering surface metal oxide layer, the system comprising:

a substrate-holding fixture disposed relative to the tank so that the portions of the substrate are submerged in the contained chemical solution;

a laser pulse source adapted to emit a plurality of laser pulses, each having a duration between 1 picosecond and 10 milliseconds and spaced apart by at least approximately 1 millisecond, and adapted to remove the interfering surface metal oxide layer and expose uncoated substrate surfaces to the action of the contained chemical solution, whereby metal-plating and etching can occur directly on the substrate without interference by the interfering surface metal oxide layer, wherein the substrate-holding fixture is further configured as an electrode and a counter-electrode is disposed in the tank forming an electrolytic cell, whereby the chemical solution contained in the tank can act to electroplate or electroetch exposed clean substrate surfaces, and wherein the chemical solution contained in the tank acts to electroplate exposed clean substrate surfaces thereby forming plated substrate surfaces, the system further comprising:

a second tank containing a second chemical solution;

a substrate transferor configured to move the substrate from the first fluid holding tank to the second fluid holding tank, the transferor disposed relative to the tanks so that the plated substrate surfaces are exposed to the action of the second contained chemical solution in the second fluid holding tank, whereby metal-plating can occur directly on the plated substrate surfaces without interference by the interfering surface metal oxide layer.

* * * * *